US006472111B1

(12) United States Patent
Reynolds et al.

(10) Patent No.: US 6,472,111 B1
(45) Date of Patent: Oct. 29, 2002

(54) COLOR PHOTOTHERMOGRAPHIC ELEMENT CONTAINING A MIXTURE OF BLOCKED DEVELOPERS FOR BALANCING IMAGING LAYERS

(75) Inventors: James H. Reynolds; David H. Levy; David T. Southby, all of Rochester, NY (US)

(73) Assignee: Eastmank Kodak Company, Rochester, NY (US)

( * ) Notice: Subject to any disclaimer, the term of this patent is extended or adjusted under 35 U.S.C. 154(b) by 0 days.

(21) Appl. No.: 09/717,742

(22) Filed: Nov. 20, 2000

Related U.S. Application Data

(60) Provisional application No. 60/211,453, filed on Jun. 13, 2000.

(51) Int. Cl.[7] ..... G03C 1/42; G03C 1/43; G03C 1/498

(52) U.S. Cl. ..... 430/21; 430/404; 430/443; 430/448; 430/496; 430/502; 430/505; 430/380; 430/566; 430/619; 430/955; 430/959; 430/964

(58) Field of Search ..... 430/21, 351, 353, 430/380, 404, 443, 448, 495.1, 619, 618, 955, 959, 964, 566, 496, 502, 505

(56) References Cited

U.S. PATENT DOCUMENTS 6,306,551 B1 * 10/2001 Owczarczyk et al. ..... 430/21
6,319,640 B1 * 11/2001 Slusarek et al. ..... 430/21

OTHER PUBLICATIONS

U.S. Ser. No. 09/475,703 filed Dec. 30, 1999, Imaging Element Containing a Blocked Photographically Useful Compound, Wojciech K. Slusarek, et al.

* cited by examiner

*Primary Examiner*—Thorl Chea
(74) *Attorney, Agent, or Firm*—Chris P. Konkol

(57) ABSTRACT

This invention relates to a photothermographic color element containing a mixture of blocked developers in the same emulsion layers. By having different blocked developers or mixtures of at least two blocked developers in different color layers, it is possible to manipulate the image discrimination (at the processing temperature) in each layer and to balance the density formation or color in the different color layers. Different mixtures of blocked developers can be used in different imaging layers, to balance the Gamma, the Dmin and the Latitude in different imaging layers or color units.

36 Claims, 2 Drawing Sheets

COLOR PHOTOTHERMOGRAPHIC ELEMENT CONTAINING A MIXTURE OF BLOCKED DEVELOPERS FOR BALANCING IMAGING LAYERS

CROSS REFERENCE TO RELATED APPLICATION

Reference is made to and priority claimed from U.S. Provisional Application Serial No. 60/211,453, filed Jun. 13, 2000, entitled COLOR PHOTO THERMOGRAPHIC ELEMENT CONTAINING A MIXTURE OF BLOCKED DEVELOPERS FOR BALANCING IMAGING LAYERS.

FIELD OF THE INVENTION

This invention relates to a color photothermographic element containing a mixture of blocked developing agents. In particular, a mixture of at least two blocked developers having different onset temperatures can be used to balance the image formed in different imaging layers during thermal development, for example imaging layers in different color units.

BACKGROUND OF THE INVENTION

In conventional color photography, films containing light-sensitive silver halide are employed in hand-held cameras. Upon exposure, the film carries a latent image that is only revealed after suitable processing. These elements have historically been processed by treating the camera-exposed film with at least a developing solution having a developing agent that acts to form an image in cooperation with components in the film. Developing agents commonly used are reducing agents, for example, p-aminophenols or p-phenylenediamines.

Typically, developing agents (also herein referred to as developers) present in developer solutions are brought into reactive association with exposed photographic film elements at the time of processing. Segregation of the developer and the film element has been necessary because the incorporation of developers directly into sensitized photographic elements can lead to desensitization of the silver halide emulsion and undesirable fog. Considerable effort, however, has been directed to producing effective blocked developing agents (also referred to herein as blocked developers) that might be introduced into silver halide emulsion elements without deleterious desensitization or fog effects. Accordingly, blocked developing agents have been sought that would unblock under preselected conditions of development after which such developing agents would be free to participate in image-forming (dye or silver metal forming) reactions.

U.S. Pat. No. 3,342,599 to Reeves discloses the use of Schiff-base developer precursors. Schleigh and Faul, in a *Research Disclosure* (129 (1975) pp. 27–30), describes the quaternary blocking of color developers and the acetamido blocking of p-phenylenediamines. (All Research Disclosures referenced herein are published by Kenneth Mason Publications, Ltd., Dudley Annex, 12a North Street, Emsworth, Hampshire P010 7DQ, ENGLAND.) Subsequently, U.S. Pat. No. 4,157,915 to Hamaoka et al. and U.S. Pat. No. 4,060,418 to Waxman and Mourning describe the preparation and use of blocked p-phenylenediamines in an image-receiving sheet for color diffusion transfer. In addition to the aforementioned U.S. Pat. No. 4,157,915, blocked developing agents involving β-elimination reactions during unblocking have been disclosed in European Patent Application 393523 and kokais 57076453; 2131253; and 63123046, the latter specifically in the context of photothermographic elements.

All of these approaches have failed in practical product applications because of one or more of the following problems: desensitization of sensitized silver halide; unacceptably slow unblocking kinetics; instability of blocked developer yielding increased fog and/or decreased Dmax after storage, lack of simple methods for releasing the blocked developer, inadequate or poor image formation, and other problems. Especially in the area of photothermographic color films, other potential problems include poor discrimination and poor dye-forming activity.

Recent developments in blocking and switching chemistry have led to blocked developing agents, including p-phenylenediamines, that perform relatively well. In particular, compounds having "β-ketoester" type blocking groups (strictly, β-ketoacyl blocking groups) are described in U.S. Pat. No. 5,019,492. With the advent of the β-ketoester blocking chemistry, it has become possible to incorporate p-phenylenediamine developers in film systems in a form from which they only become active when required for development. The β-ketoacyl blocked developers are released from the film layers in which they are incorporated by an alkaline developing solution containing a dinucleophile, for example hydroxylamine.

It is an object of the invention to obtain improved color photothermographic imaging elements and methods for their development employing incorporated blocked developing agents, also referred to herein as blocked developers. With respect to color photothermographic imaging elements, it is desirable to employ a blocked developer that is stable until development yet can rapidly and easily develop a high quality image once processing has been initiated by heating the element or by applying to the element a processing solution during or after heating, such as a solution of a base or acid or pure water. A completely dry process or an apparently dry process (for example, in which the volume of aqueous solutions is small enough to be applied by a laminate) is most desirable and, in fact, the eliminating the application of all or most solutions and photochemical processing chemicals is one of the main advantages of a dry or apparently dry photothermographic system. The existence of such a process would allow for very rapidly processed films that can be processed simply and efficiently in photoprocessing kiosks. Such kiosks, with increased numbers and accessibility, could ultimately allow for, relatively speaking, anytime and anywhere silver-halide film development.

One of the factors to be considered, with respect to a blocked developer in a color photothermographic element, is the onset temperature of the blocked developer, that is, the temperature at which the compound becomes substantially unblocked or activated, which is generally a measure or indication of the temperature at which the development process will need to be performed. In generally, other factors being equal, the higher the onset temperature, the higher the process temperature. A process at lower temperatures generally has less side reactions and is less expensive to accomplish. There is less potential deformation of the film base which can adversely affect image quality. Also, higher temperatures tend to undesirably decompose components in the photographic element and release volatile vapors.

Another factor to be considered, with respect to a blocked developer in a photothermographic element, is the discrimination of the image, generally defined as the difference of between Dmin and Dmax at the process temperature. Since the discrimination of an image, using a blocked developer, will generally vary with process temperature, it is usually desirable to process the film at the temperature of peak discrimination (in the photographic element). It is further desirable that the film have a high peak discrimination. Discrimination of a film can be affected by a number of factors, including photographic emulsion type and finish, the kind and amount of couple, the thermal solvent, and other factors. However, a key factor is the blocked developing agent incorporated in the photothermographic film.

A problem with a blocked developer is that discrimination may be poor if the blocked developer unblocks to quickly or does not unblock quickly enough. It is advantageous to appropriately balance the reactivity of the developing agent, during developing, with the rate of release of the developing agent from the blocked developing agent. If the reactivity of developing agent with the coupling agent (or "coupler") to form the image dye is too much less than the rate of release of the developing agent, at a particular temperature, then there is the opportunity for side reactions to occur which may decrease the discrimination. (usually by increasing fog) and consequently decrease image quality. On the other hand, if the reactivity of the developing agent with the coupling agent is too much greater than the rate of release of the developing agent, at the temperature of development, then there may not be enough developing agent for image formation to occur which may also decrease discrimination (this time, usually by decreasing Dmax) which again will consequently decrease image quality.

Another problem with blocked developers is that, if the relative discrimination curve (a graph of peak discrimination versus temperature of processing) is too narrow, then the release of the blocked developer in the photographic element as the temperature of the element increases may not be well timed. This may result, for example, in only a small portion of the blocked developer being unblocked as the photographic element is being heated and then, as the element nears the equilibrium temperature, a large amount of blocked developer being unblocked all at once, drowning the coupler with an excess of developing agent, resulting in poor discrimination (high Dmin). It is to be understood that, even though a heater may reach its equilibrium temperature quickly, the photographic element may take some process time to reach its equilibrium or peak temperature, which optionally may be set higher than the temperature of peak discrimination in order to speed the development process.

In general, a broader and flatter relative discrimination curve is desirable. Not only is it more robust relative to variations in process conditions, but it can provide a relatively steady release or unblocking of the developing agent so that the release of the developing agent better matches the reactivity of the developing agent with the coupler and its concentration. This can increase the amount of development occurring at a temperature in the vicinity of peak discrimination for the process. In other words, there is a broader temperature area (element temperature) over which peak discrimination, or near peak discrimination, occurs.

Thus, it would be desirable if a higher percentage of peak discrimination for the photothermographic element occurs within over a given temperature range around the peak discrimination temperature, wherein peak discrimination temperature is defined as the temperature at which discrimination peaks when heating the photographic element.

If the relative discrimination curve is narrow, then the photographic element may reach its peak discrimination temperature very quickly without having had time to release the developing agent and then may release the developing agent all at once, which would result, as mentioned above, in the flooding the couplers and poor discrimination. Although one might compensate by heating slower, it is desirable to heat the photographic element quickly to avoid adverse affects of prolonged heating on the photographic element. Thus, it is better to have flatter curve, to provide maximum discrimination for the time period and temperature range of the photothermographic element during the heating process.

It is also desirable to balance the discrimination between layers, particularly between or among color units, of which there are typically three in a color film. A problem with color film has been the fact that the discrimination in different color layers can vary considerably, more so than in conventional film. A blocked developing agent may have the correct reactivity in one color layer, but may have too much reactivity or too little reactivity in another color layer.

An individual blocked developer can react with distinct couplers to form dyes of distinct hues. A problem arises when a single blocked developer is employed to form distinct dye deposits of different hue in distinct color record layer units of a film since the distinct couplers can react with the released developer at distinct rates and form dye deposits differing in gamma, speed and density. These differences in turn lead to color records that are practically imbalanced and can be difficult to scan.

Distinct blocked developers are employed in one or more of the color records to solve this problem. The blocked developer can be matched with the couplers employed in distinct color records to provide dye records of a desired hue and stability, and simultaneously having desired gamma, latitude and density characteristics suitable for scanning. In this context, the hue and stability of a chromogenic dye deposit in a specific layer is controlled by the identity of the coupler, the identity of the developer and the presence and level of any coupler solvent or melt former. The gamma, latitude, and density however can be controlled by choice of the moiety chosen to block the active sites of a developer and by the identity and level of any present melt former.

For example, a film can be prepared having three color forming layer units respectively sensitive to blue, green and red light. A distinct coupler chosen to provide a dye of distinct hue and stability and suitable for scanning when that coupler reacts with a specific developer is associated with each color unit. A blocked developer is placed in reactive association with each color unit. The blocking moiety of each blocked developer is chosen to enable release of the developer at a rate suitable for the formation of a dye deposit having desired latitude, density, fog and gamma characteristics. The developer moiety of the blocked developer for each layer unit is chosen to provide a dye of desired hue and stability. Thus, film structures having a desired dye hue, dye stability, latitude, density, fog and gamma are prepared. It is possible for a common developing agent to be employed in the blocked developers in the aforesaid mentioned color film but with distinct blocking moieties. It is also possible to employ a common blocking moiety in the blocked developers in the aforesaid mentioned color film but with distinct developing agents. It is also possible to incorporate a melt formers or other addenda which can be selected to modulate the hue, density, reactivity, speed, gamma, fog and stability characteristics of the formed dye deposits.

Nevertheless, it is extremely difficult to develop separate blocked developers for different imaging layers in which the layers are well balanced.

It is an object of this invention, and it would be highly desirable, to obtain a color photothermographic element in which the density and color is well balanced between different imaging layers, especially in different color units.

DEFINITION OF TERMS

The term "onset temperature" or $T_o$ is defined as the temperature required to produce a maximum density (Dmax) of 0.5, as described in the Examples below. Lower temperatures indicate more active developers which are desirable.

The term "process temperature" is defined herein as the maximum temperature present in the photographic element during the development process, which may approximate the maximum temperature of the environment with which the photographic element is directly contacted during the development process, which in turn can approximate the temperature of the heating element (source of heat) during the development process in cases of good heat transfer.

The term "discrimination" herein generally means the difference between Dmax and Dmin in an imaging layer.

The term "peak discrimination" or $D_P$ is defined, as in the Examples, for the optimum platen temperature, as corresponding to the value of the difference between Dmax and Dmin (Dmax–Dmin) divided by Dmin.

The term "relative discrimination curve" herein means the discrimination as the temperature of the blocked developer varies.

The term "peak discrimination temperature" herein means the maximum discrimination in the relative discrimination curve.

The term "E" means herein the exposure in lux-seconds.

The term "gamma ratio' when applied to a color recording layer unit refers to the ratio determined by dividing the color gamma of a cited layer unit after an imagewise color separation exposure and process that enables development of primarily that layer unit by the color gamma of the same layer unit after imagewise white light exposure and process that enables development of all layer units. In turn, the term "gamma" is employed to indicate the incremental increase in image density (ΔD)produced by a corresponding incremental increase in log exposure (Δlog E)and indicates the maximum gamma measured over an exposure range extending between a first characteristic curve reference point lying at a density of 0.15 above minimum density and a second characteristic curve reference point separated from the first reference point by 0.9 log E.

The term "coupler" indicates a compound that reacts with oxidized color developing agent to create or modify the hue of a dye chromophore.

In referring to blue, green and red recording dye image-forming layer units, the term "layer unit" indicates the hydrophilic colloid layer or layers that contain radiation-sensitive silver halide grains to capture exposing radiation and couplers that react upon development of the grains. The grains and couplers are usually in the same layer, but can be in adjacent layers.

The term "dye image-forming coupler" indicates a coupler that reacts with oxidized color developing agent to produce a dye image.

*Research Disclosure* is published by Kenneth Mason Publications, Ltd., Dudley House, 12 North St., Emsworth, Hampshire P010 7DQ, England.

The term "one-time-use camera" or "OTUC" is used to indicate a camera supplied to the user preloaded with a light sensitive silver halide photographic element and having a lens and shutter. The terms "single-use camera," "film-with-lens unit," "disposable camera" and the like are also employed in the art for cameras that are intended for one use, after which they are recycled, subsequent to removal of the film for development.

The term "exposure latitude" indicates the exposure range of a characteristic curve segment over which instantaneous gamma (ΔD/Δlog E) is at least 25 percent of gamma, as defined above. The exposure latitude of a color element having multiple color recording units is the exposure range over which the characteristic curves of the red, green, and blue color recording units simultaneously fulfill the aforesaid definition.

The term "absorption half-peak bandwidth" indicates the spectral range over which a dye exhibits an absorption equal to at least half of its peak absorption.

SUMMARY OF THE INVENTION

By having different blocked developers or mixtures of at least two blocked developers in different color layers, it is possible to manipulate, the image discrimination (at the processing temperature) in each layer and to balance the density formation or color in the different color layers. Different mixtures of blocked developers can be used in different imaging layers, to balance the density formation in distinct color records.

Accordingly, at least one Blocked Developer C is used in a first imaging layer (Layer 1) and a mixture of at least two blocked developers, Blocked Developers A and B is used in a second imaging layer (Layer 2). Preferably, Layer 1 and 2 are in different color units, although they may be in the same color unit.

According to one embodiment of the invention, the Gamma Ratio (at the process temperature) of the Gamma in Layer 1 or Color Unit 1 to the Gamma in Layer 2 or Color Unit 2 is between 0.8 and 1.2, preferably 0.9 and 1.1, and wherein this Gamma Ratio is at least 10% closer to 1.0 than if only one of Blocked Developers A, B, and C are independently used in each of Layer/Color Unit 1 and Layer/Color Unit 2.

According to a second embodiment of the invention, the Dmin Ratio (at the process temperature) of the Dmin in Layer 1 or Color Unit 1 to the Dmin in Layer 2 or Color Unit 2 is between 0.8 and 1.2, preferably 0.9 and 1.1, and wherein this Dmin ratio is at least 10% closer to 1.0 than if only one of Blocked Developers A, B, and C are independently used in each of Layer/Color Unit 1 and Layer/Color Unit 2.

According to a third embodiment of the invention, the Latitude Ratio (at the process temperature) of the Latitude in Layer 1 or Color Unit 1 to the Latitude in Layer 2 or Color Unit 2 is between 0.8 and 1.2, preferably 0.9 and 1.1, and wherein this Latitude Ratio is at least 10% closer to 1.0 than if only one of Blocked Developers A, B, and C are independently used in each of Layer/Color Unit 1 or Layer/Color Unit 2.

Thus, this invention relates to a photothermographic color element containing a mixture of at least two different blocked developers in the same emulsion layer, which blocked developers having different onset temperatures.

By different blocked developers is meant two blocked developing agents having (1) the same developing agent upon unblocking, but having different blocking/timing groups, (2) the same blocking and/or timing groups but different developing agents when unblocked, and/or (3) both different developing agents upon complete unblocking and different blocking and/or timing groups.

Thus, the present invention can be used as a film-building tool. A different blocked developer in one layer can be used to increase the reactivity of a layer relative to another and consequently allow more development in a layer as needed and/or a different blocking moiety on the developing agent (including blocking and timing groups) may be used so that more developing agent can be released at a certain process temperature. The concentration of developing agent and the concentration of the coupler can be balanced to get comparable amounts of dye in each layer of color unit. When the extinction of dye lower in a layer or color unit, then more developing agent may be used to get a comparable amount of density. Thus, the present invention can be used to balance the sensitometric curve. A range of adjustments in the sensitometry in different layers can be made by using mixtures of blocked developers and by varying the proportion of the blocked developers in the mixture.

The term blocking/timing group is meant the portion of the blocked developer other than the developing agent that reacts with a coupler. The blocking/timing group, therefore, separates from the developing agent, even if in stages, over time.

In one embodiment of the invention, mixtures of blocked developers have been found that provide lower processing temperatures and/or shorter times of development compared to the blocked developer alone having the higher onset temperature, and at the same time, improved discrimination compared to the blocked developer alone having the lower onset temperature. In some cases, higher peak discrimination than obtainable with either of the blocked developers alone at the given process temperature is obtainable.

In another embodiment of the invention, mixtures of blocked developers have been found that provide a lower gamma of the relative discrimination curve at the processing temperature, thereby providing a generally flatter and more robust relative discrimination curve compared to either blocked developer alone.

Preferably, when the developer mixture is used in a dry physical development system, the developer is thermally activated at temperatures between about 80 and 180° C., preferably 100 to 170° C. When the developer is used in an apparently dry chemical development system, however, the developer mixture is preferably thermally activated at temperatures between about 60 and 120° C., preferable 65 to 100° C., in the presence of added acid, base or water.

In particular, the present invention is directed to a color photothermographic color element comprising at least three light-sensitive units that have their individual sensitivities in different wavelength regions comprising a silver halide imaging layer having associated therewith a mixture of at least two blocked developing agents comprising a Blocked Developer A and blocked Developer B independently represented by Structure I:

$$\text{DEV—(LINK 1)}_l\text{—(TIME)}_m\text{—(LINK 2)}_n\text{—M}$$

wherein,

DEV is a silver-halide color developing agent;

LINK 1 and LINK 2 are linking groups;

TIME is a timing group;

l is 0 or 1;

m is 0, 1, or 2;

n is 0 or 4;

l+n is 1 or 2;

M is a blocking group or M is:

$$\text{—M'—(LINK 2)}_n\text{—(TIME)}_m\text{—(LINK 1)}_l\text{DEV}$$

wherein M' is a blocking group that also contains another blocked developer, which may be the same or a different developing agents; and wherein the onset temperature of Blocked Developer A is less than the onset temperature of Blocked Developer B, the onset temperature of Blocked Developer A is in the range of 110C. to 160C., preferably 110 to 150, and the onset temperature of Blocked Developer B is in the range of 130 to 170C., preferably 140 to 160C., and the difference in the onset temperatures of the two Blocked Developers is 5 to 50C., preferably 8 to 40, more preferably 10 to 30C.

In a preferred embodiment of the invention, the peak discrimination of the mixture of Blocked Developer A and Blocked Developer B will be higher that the discrimination of Blocked Developer B. In a particularly preferred embodiment, the peak discrimination of the mixture is higher than the peak discrimination of both Blocked Developer A and Blocked Developer B.

The invention additionally relates to a method of image formation having the steps of: thermally developing an imagewise exposed photographic element having a mixture of blocked developers as described above that decomposes to release corresponding developing agents on thermal activation to form a developed image. Preferably, following development, the developed image is then scanned to form a first electronic-image representation (or "electronic record") from said developed image, the first electronic record is digitized to form a digital image, and the digital image is modified to form a second electronic-image representation, which can be stored, transmitted, printed or displayed.

The invention further relates to a one-time use camera having a light sensitive photographic element comprising a support and a mixture of blocked developers as described above that releases a mixture of developing agents or differentially releases the same developing agents (in the same or different imaging layers) on thermal activation. The invention further relates to a method of image formation having the steps of imagewise exposing such a light sensitive photographic element on thermal activation in a one-time-use camera having a heater and thermally processing the exposed element in the camera.

In a preferred embodiment of the invention, LINK 1 and LINK 2 are of structure II:

II

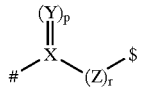

wherein

X represents carbon or sulfur;

Y represents oxygen, sulfur or N—$R_1$, where $R_1$ is substituted or unsubstituted alkyl or substituted or unsubstituted aryl;

p is 1 or 2;

Z represents carbon, oxygen or sulfur;

r is 0 or 1;

with the proviso that when X is carbon, both p and r are 1, when X is sulfur, Y is oxygen, p is 2 and r is 0;

# denotes the bond to PUG (for LINK 1) or TIME (for LINK 2):

$ denotes the bond to TIME (for LINK 1) or $T_{(t)}$ substituted carbon (for LINK 2).

DETAILED DESCRIPTION OF THE INVENTION

Figure 1:
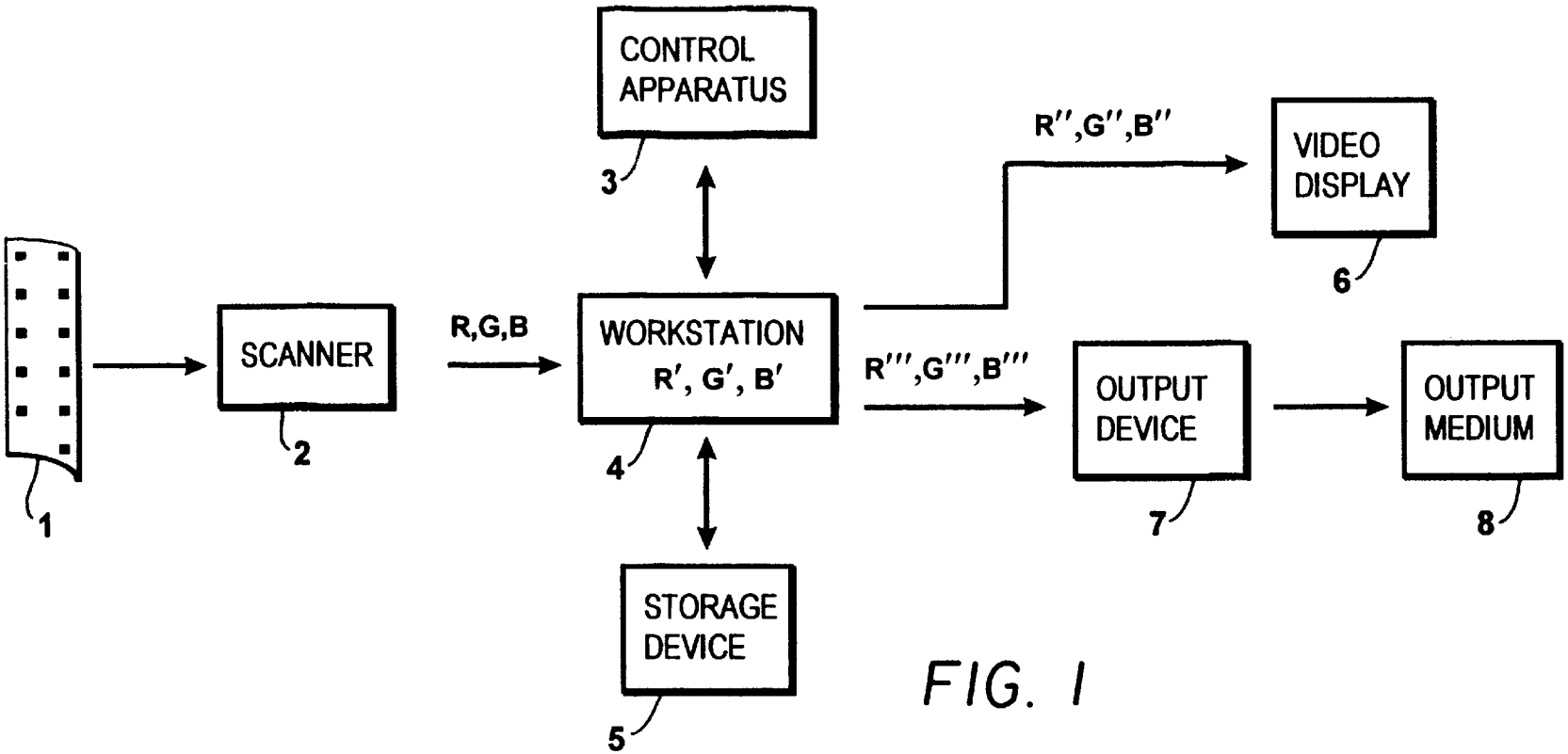
FIG. 1 shows in block diagram form an apparatus for processing and viewing image formation obtained by scanning the elements of the invention.
Figure 2:
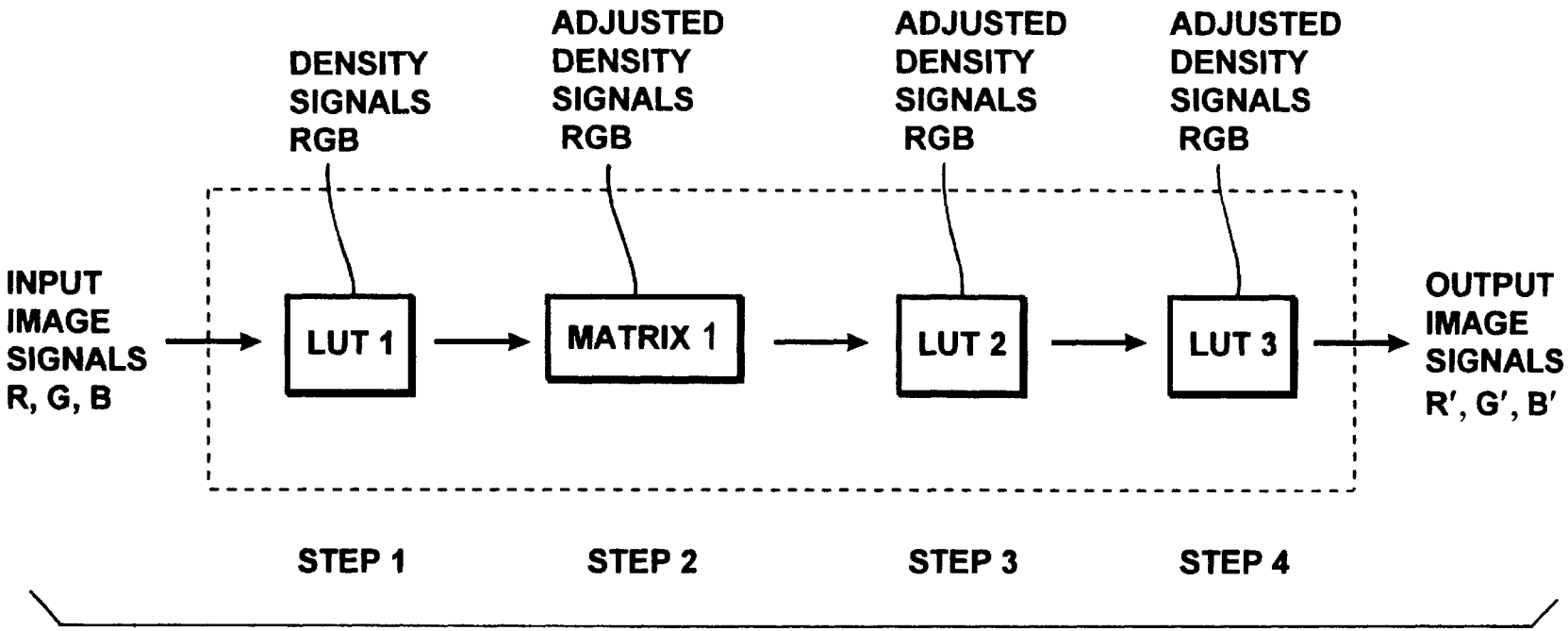
FIG. 2 shows a block diagram showing electronic signal processing of image bearing signals derived from scanning a developed color element according to the invention.

In Structure I above, the developing agents are silver halide, dye-forming developing agents. The developing agent can be present in the blocked compound as a preformed species or as a precursor. They include aminophenols, phenylenediamines, hydroquinones, pyrazolidinones, and hydrazines. Illustrative developing agents are described in U.S. Pat. Nos. 2,193,015, 2,108,243, 2,592,364, 3,656,950, 3,658,525, 2,751,297, 2,289,367, 2,772,282, 2,743,279, 2,753,256, and 2,304,953, the entire disclosures of which are incorporated herein by reference.

Illustrative developers are as follows:

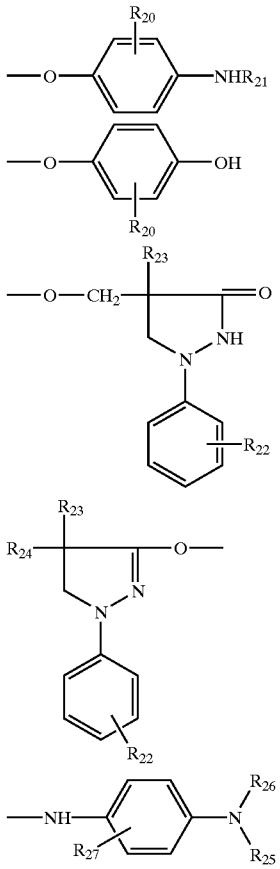

-continued

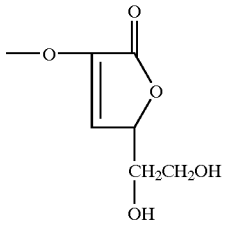

wherein $R_{20}$ is hydrogen, halogen, alkyl or alkoxy;

$R_{21}$ is a hydrogen or alkyl;

$R_{22}$ is hydrogen, alkyl, alkoxy or alkenedioxy; and $R_{23}$, $R_{24}$, $R_{25}$ $R_{26}$ and $R_{27}$ are hydrogen alkyl, hydroxyalkyl or sulfoalkyl.

As mentioned above, in a preferred embodiment of the invention, LINK 1 or LINK 2 are of structure II:

II

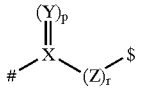

wherein

X represents carbon or sulfur;

Y represents oxygen, sulfur of N—$R_1$, where $R_1$ is substituted or unsubstituted alkyl or substituted or unsubstituted aryl;

p is 1 or 2;

Z represents carbon, oxygen or sulfur;

r is 0 or 1;

with the proviso that when X is carbon, both p and r are 1, when X is sulfur, Y is oxygen, p is 2 and r is 0;

# denotes the bond to PUG (for LINK 1) or TIME (for LINK 2):

$ denotes the bond to TIME (for LINK 1) or $T_{(t)}$ substituted carbon (for LINK 2).

Illustrative linking groups include, for example,

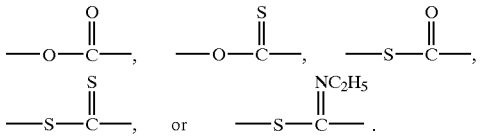

TIME is a timing group. Such groups are well-known in the art such as (1) groups utilizing an aromatic nucleophilic substitution reaction as disclosed in U.S. Pat. No. 5,262,291; (2) groups utilizing the cleavage reaction of a hemiacetal (U.S. Pat. No. 4,146,396, Japanese Applications 60-249148; 60-249149); (3) groups utilizing an electron transfer reaction along a conjugated system (U.S. Pat. Nos. 4,409,323; 4,421,845; Japanese Applications 57-188035; 58-98728; 58-209736; 58-209738); and (4) groups using an intramolecular nucleophilic substitution reaction (U.S. Pat. No. 4,248,962).

Illustrative timing groups are illustrated by formulae T-1 through T-4.

T-1

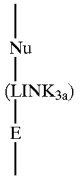

wherein:

Nu is a nucleophilic group;

E is an electrophilic group comprising one or more carbo- or hetero-aromatic rings, containing an electron deficient carbon atom;

LINK 3 is a linking group that provides 1 to 5 atoms in the direct path between the nucleophilic site of Nu and the electron deficient carbon atom in E; and a is 0 or 1.

Such timing groups include, for example:

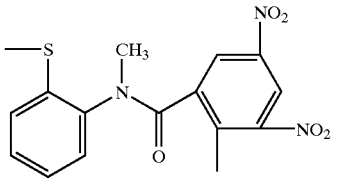

and

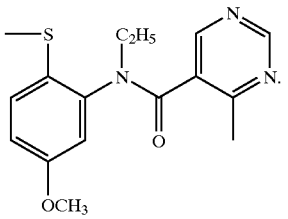

These timing groups are described more fully in U.S. Pat. No. 5,262,291, incorporated herein by reference.

T-2

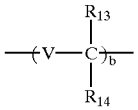

wherein

V represents an oxygen atom, a sulfur atom, or an

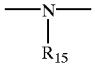

group;

$R_{13}$ and $R_{14}$ each represents a hydrogen atom or a substituent group;

$R_{15}$ represents a substituent group; and b represents 1 or 2.

Typical examples of $R_{13}$ and $R_{14}$, when they represent substituent groups, and $R_{15}$ include

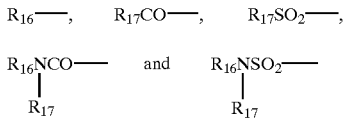

where, $R_{16}$ represents an aliphatic or aromatic hydrocarbon residue, or a heterocyclic group; and $R_{17}$ represents a hydrogen atom, an aliphatic or aromatic hydrocarbon residue, or a heterocyclic group, $R_{13}$, $R_{14}$ and $R_{15}$ each may represent a divalent group, and any two of them combine with each other to complete a ring structure. Specific examples of the group represented by formula (T-2) are illustrated below.

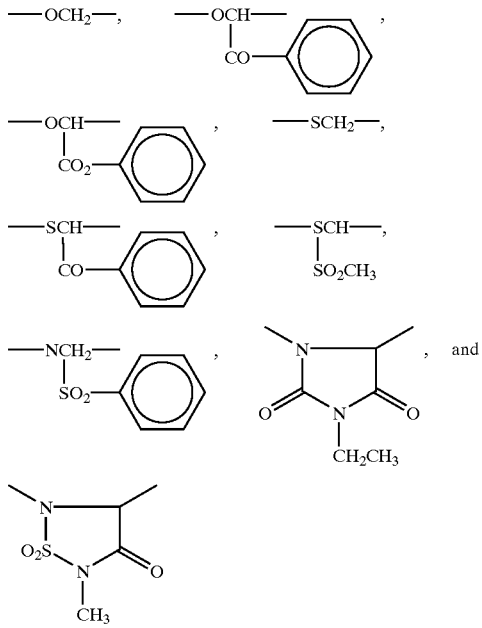

T-3 wherein Nu 1 represents a nucleophilic group, and an oxygen or sulfur atom can be given as an example of nucleophilic species; E1 represents an electrophilic group being a group which is subjected to nucleophilic attack by Nu 1; and LINK 4 represents a linking group which enables Nu 1 and E1 to have a steric arrangement such that an intramolecular nucleophilic substitution reaction can occur. Specific examples of the group represented by formula (T-3) are illustrated below.

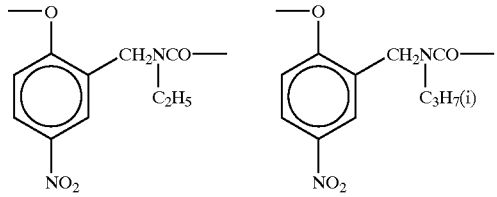

-continued

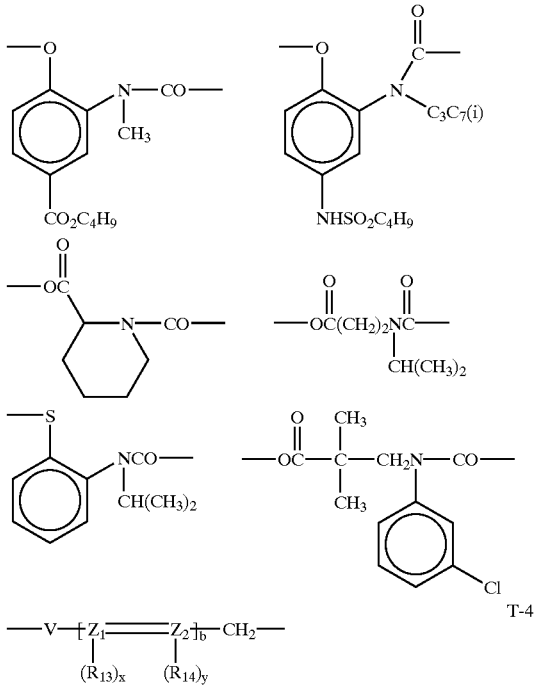

T-4 wherein V, $R_{13}$, $R_{14}$ and b all have the same meaning as in formula (T-2), respectively. In addition, $R_{13}$ and $R_{14}$ may be joined together to form a benzene ring or a heterocyclic ring, or V may be joined with $R_{13}$ or $R_{14}$ to form a benzene or heterocyclic ring. $Z_1$ and $Z_2$ each independently represents a carbon atom or a nitrogen atom, and x and y each represents 0 or 1.

Specific examples of the timing group (T-4) are illustrated below.

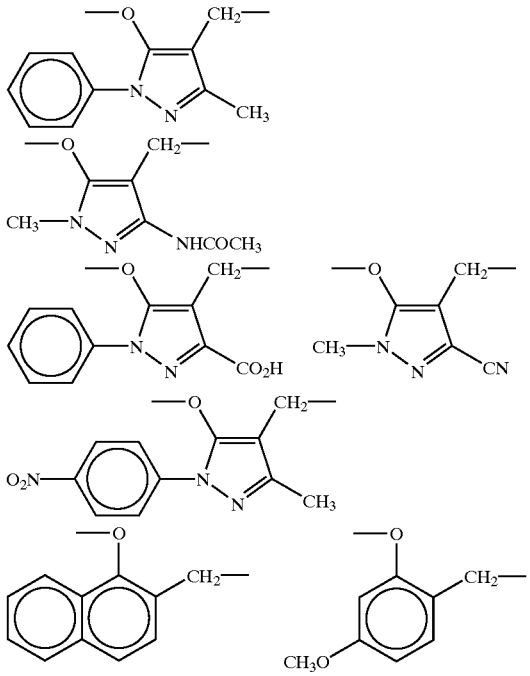

-continued

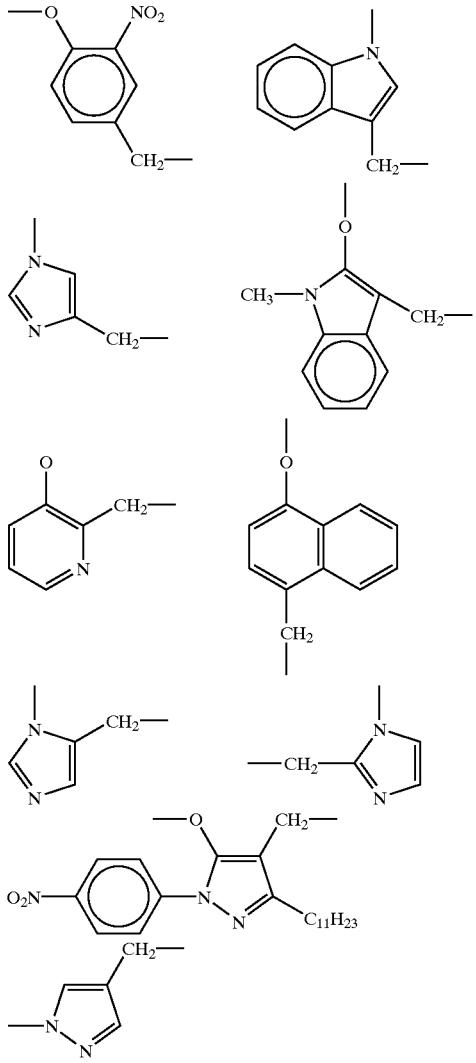

As mentioned above, by having different blocked developers or mixtures of at least two blocked developers in different color layers, it is possible to manipulate the image discrimination (at the processing temperature) in each layer and to balance the density formation or color in the different color layers. Different mixtures of blocked developers can be used in different imaging layers, to balance the density formation in distinct color records.

Accordingly, at least one Blocked Developer A is used in a first imaging layer (Layer 1) and a mixture of at least two blocked developers, Blocked Developers B and C is used in a second imaging layer (Layer 2). Preferably, Layer 1 and 2 are in different color units, although they may be in the same color unit.

According to one embodiment of the invention, the Gamma Ratio (at the process temperature) of the Gamma in Layer 1 to the Gamma in Layer 2 is between 0.8 and 1.2, preferably 0.9 and 1.1, and wherein this Gamma Ratio is at least 10% closer to 1.0 than if only one of Blocked Developers A, B, and C are independently used in each of Layer,l and Layer 2.

According to a second embodiment of the invention, the Dmin Ratio (at the process temperature) of the Dmin in Layer 1 to the Dmin in Layer 2 is between 0.8 and 1.2, preferably 0.9 and 1.1, and wherein this Dmin ratio is at least 10% closer to 1.0 than if only one of Blocked Developers A, B, and C are independently used in each of Layer 1 and Layer 2.

According to a third embodiment of the invention, the Latitude Ratio (at the process temperature) of the Latitude in Layer 1 to the Latitude in Layer 2 is between 0.8 and 1.2, preferably 0.9 and 1.1, and wherein this Latitude Ratio is at least 10% closer to 1.0 than if only one of Blocked Developers A, B, and C are independently used in each of Layer 1 and Layer 2.

Thus, this invention relates to a photothermographic color element containing a mixture of at least two different blocked developers in the same emulsion layer, which blocked developers having different onset temperatures.

As a film-building tool, different blocked developer in one layer can be used to increase the reactivity of a layer relative to another and consequently allow more development in a layer as needed and/or a different blocking moiety on the developing agent (including blocking and timing groups) may be used so that more developing agent can be released at a certain process temperature. The concentration of developing agent and the concentration of the coupler can be balanced to get comparable amounts of dye in each layer of color unit. When the extinction of dye lower in a layer or color unit, then more developing agent may be used to get a comparable amount of density. Thus, the present invention can be used to balance the sensitometric curve. A range of adjustments in the sensitometry in different layers can be made by using mixtures of blocked developers and by varying the proportion of the blocked developers in the mixture.

In one embodiment of the invention, mixtures of blocked developers have been found that provide lower processing temperatures and/or shorter times of development compared to the blocked developer alone having the higher onset temperature, and at the same time, improved discrimination compared to the blocked developer alone having the lower onset temperature. In some cases, higher peak discrimination than obtainable with either of the blocked developers alone at the given process temperature is obtainable.

In another embodiment of the invention, mixtures of blocked developers have been found that provide a lower gamma of the relative discrimination curve at the processing temperature, thereby providing a generally flatter and more robust relative discrimination curve compared to either blocked developer alone.

In one embodiment of the invention, the mixture of blocked developers comprises a first blocked developer (Blocked Developer A) having a relatively lower onset temperature, and a second blocked developer (Blocked Developer B) having a relatively higher onset temperature. Suitably, the onset temperature of Developer A is in the range of 110 to 160 C., preferably 110 to 150 and the onset temperature of Blocked Developer B is in the range 130 to 170 C., and the difference in the onset temperatures of the two developing agents are 5 to 50 C., preferably 8 to 40, more preferably 10 to 30 C.

Suitably, the ratio or relative amounts of the at least two developing agent can be adjusted to obtain the desired property of the mixture. Suitably, Blocked Developer A is present in the amount of 5 to 95 mole percent, preferably 20 to 80 mole percent, and Developing Agent B is present in the amount of 95 to 5 mole percent, preferably 80 to 20 mole percent. There may be more than two developing agents in a mixture. However, where a third developing agent or a third and fourth developing agent is present, the additional developing agents are preferably in an amount less than 30 percent, more preferably less than 20 percent, most preferably less than 10 percent.

As indicated above, the mixture of blocked developing agents can also be selected to increase the peak discrimination relative to one or both of the blocked developers. This is usually desirable because it provides a higher quality image. The mixture of blocked developing agents can also be adjusted so that the relative discrimination curve is flatter than that of either blocked developer alone. This is usually desirable, so that the heating process is more robust. In this case, the overall discrimination, with respect to the overall temperature range of development, is higher than either individual blocked developing agents alone, even if not strictly cumulative.

As indicated above, the photothermographic color element comprises at least three light-sensitive units that have their individual sensitivities in different wavelength regions comprsing a silver halide imaging layer having associated therewith a mixture of at least two blocked developing agents comprising Blocked Developer A and a Blocked Developer B independently having Structure I:

$$\text{DEV—(LINK 1)}_l\text{—(TIME)}_m\text{—(LINK 2)}_u\text{—M}$$

wherein,

DEV is a silver halide color developing agent;

LINK 1 and LINK 2 are linking groups;

TIME is a timing group;

l is 0 or 1;

m in 0, 1, or 2;

n is 0 or 1;

l+n is 1 or 2;

M is a blocking group or M is:

$$\text{—M'—(LINK 2)}_n\text{—(TIME)}_m\text{—(LINK 1)}_l\text{—DEV}$$

wherein M' is also a blocking group for a second developing agent.

In a preferred embodiment of the invention, at least one of the blocked developing agents have the Structure II:

II

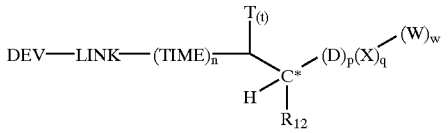

wherein:

DEV is a developing agent;

LINK is a linking group as defined above;

TIME is a timing group as defined above;

n is 0, 1, or 2;

t is 0, 1, or 2, and when t is not 2, the necessary number of hydrogens (2-t) are present in the structure;

C* is tetrahedral ($sp^3$ hybridized) carbon;

p is 0 or 1;

q is 0, or 1;

w is 0 or 1;

p+q=1 and when p is 1, q and w are both 0; when q is 1, then w is 1;

$R_{12}$ is hydrogen, or a substituted or unsubstituted alkyl, cycloalkyl, aryl or heterocyclic group or $R_{12}$ can combine with W to form a ring;

T is independently selected from a substituted or unsubstituted (referring to the following T groups) alkyl group, cycloalkyl group, aryl, or heterocyclic group, an inorganic monovalent electron withdrawing group, or an inorganic divalent electron withdrawing group capped with at least one C1 to C10 organic group (either an $R_{13}$ or an $R_{13}$ and $R_{14}$ group), preferably capped with a substituted or unsubstituted alkyl or aryl group; or T is joined with W or $R_{12}$ to form a ring; or two T groups can combine to form a ring;

T is an activating group when T is an (organic or inorganic) electron withdrawing group, an aryl group substituted with one to seven electron withdrawing groups, or a substituted or unsubstituted heteroaromatic group. Preferably, T is an inorganic group such as halogen, —$NO_2$, —CN, a halogenated alkyl group, for example —$CF_3$, or an inorganic electron withdrawing group capped by $R_{13}$ or by $R_{13}$ and $R_{14}$, for example, —$SO_2R_{13}$, —$OSO_2R_{13}$, —$NR_{14}(SO_2R_{13})$, —$CO_2R_{13}$, —$COR_{13}$, —$NR_{14}(COR_{13})$, etc.

D is a first activating group selected from substituted or unsubstituted (referring to the following D groups) heteroaromatic group or aryl group or monovalent electron withdrawing group, wherein the heteroaromatic can optionally form a ring with T or $R_{12}$;

X is a second activating group and is a divalent electron withdrawing group. The X groups comprise an oxidized carbon, sulfur, or phosphorous atom that is connected to at least one W group. Preferably, the X group does not contain any hydrogenated carbons except for any side groups attached to a nitrogen, oxygen, sulfur or phosphorous atom. The X groups include, for example, —CO—, —$SO_2$—, —$SO_2O$—, —COO—, —$SO_2N(R_{15})$—, —$CON(R_{15})$—, —$OPO(OR_{15})$—, —$PO(R_{15})N(R_{16})$—, and the like, in which the atoms in the backbone of the X group (in a direct line between the C* and W) are not attached to any hydrogen atoms.

W is W' or a group represented by the following Structure IIA:

IIA

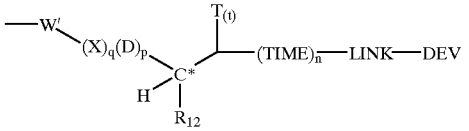

W' is independently selected from a substituted or unsubstituted (referring to the following W' groups) alkyl (preferably containing 1 to 6 carbon atoms), cycloalkyl (including bicycloalkyls, but preferably containing 4 to 6 carbon atoms), aryl (such as phenyl or naphthyl) or heterocyclic group; and wherein W' in combination with T or $R_{12}$ can form a ring (in the case of Structure IA, W' comprises a least one substituent, namely the moiety to the right of the W' group in Structure IA, which substituent is by definition activating, comprising either X or D);

W is an activating group when W has structure IA or when W' is an alkyl or cycloalkyl group substituted with one or more electron withdrawing groups; an aryl group substituted with one to seven electron withdrawing groups, a substituted or unsubstituted heteroaromatic group; or a non-aromatic heterocyclic when substituted with one or more electron withdrawing groups. More preferably, when W is substituted with an electron withdrawing group, the substituent is an inorganic group such as halogen, —$NO_2$, —CN, or a halogenated alkyl group, e.g., —$CF_3$, or an inorganic group capped by $R_{13}$ (or by $R_{13}$ and $R_{14}$), for example —$SO_2R_{13}$, —$OSO_2R_{13}$, —$NR_{13}(SO_2R_{14})$, —$CO_2R_{13}$, —$COR_{13}$, —$NR_{13}(COR_{14})$, etc.

$R_{13}$, $R_{14}$, $R_{15}$, and $R_{16}$ can independently be selected from substituted or unsubstituted alkyl, aryl, or heterocyclic group, preferably having 1 to 6 carbon atoms, more preferably a phenyl or C1 to C6 alkyl group.

Any two members of the set $R_{12}$, T, and either D or W, that are not directly linked, may be joined to form a ring, provided that creation of the ring will not interfere with the functioning of the blocking group.

More preferably, the blocked developers used in the present invention is within Structure I above, but represented by the following narrower Structure IIB:

Structure IIB

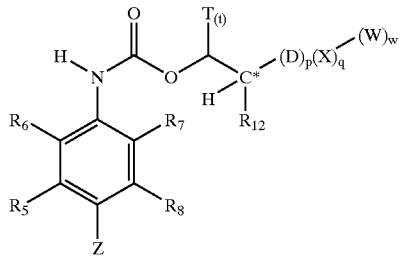

It will be noticed that the M group in Structure I, according to Structure II has the following structure:

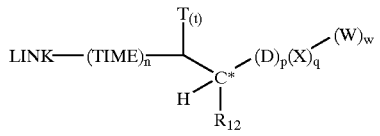

This class of blocked developing agents is believed to involve an unblocking reaction that is a 1, 2 elimination with respect to the bond between the carbons alpha and beta to the adjacent linking groups.

In another embodiment of the invention, both Blocked Developers A and B fall within the scope of Structure II or IIB.

The following are representative examples of blocked developer compounds of Structure II for use in the invention:

D-1

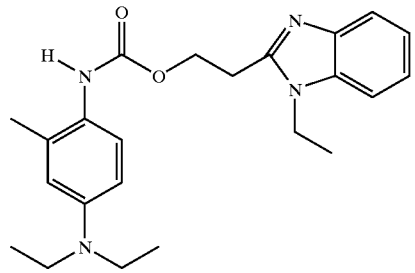

-continued
D-2
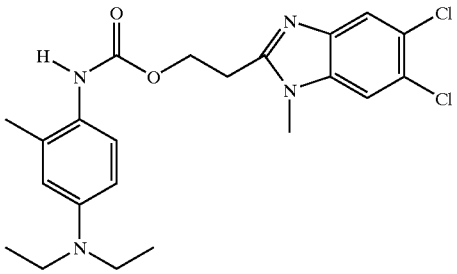
D-3
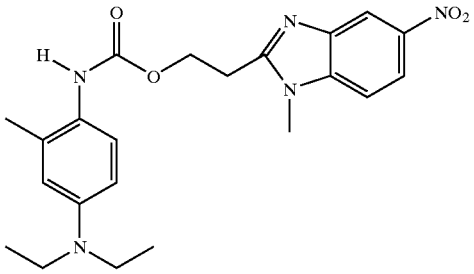
D-4
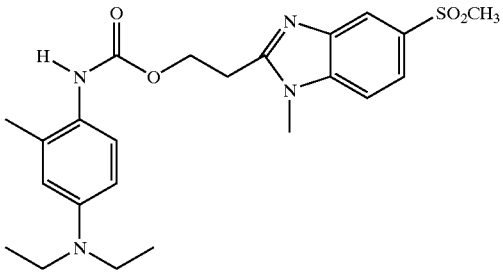
D-5
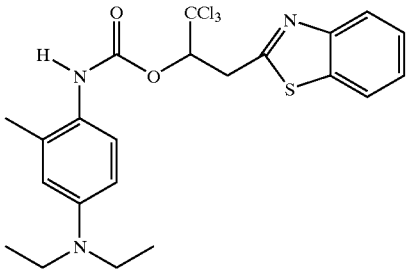
D-6
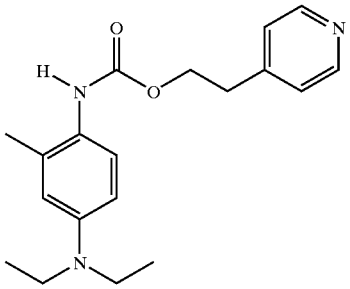
-continued
D-7
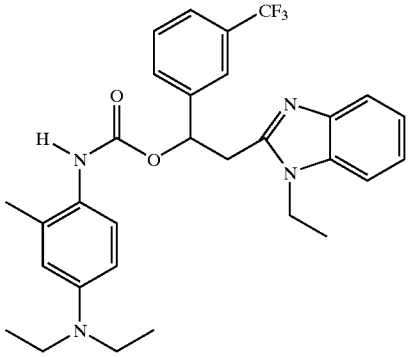
D-8
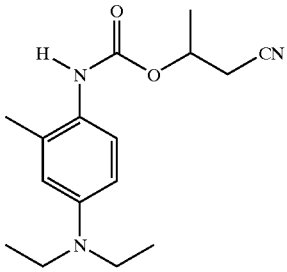
D-9
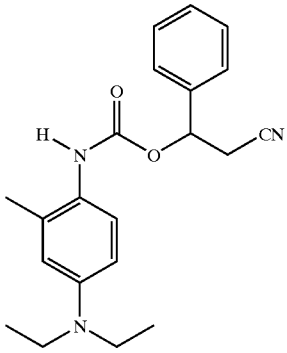
D-10
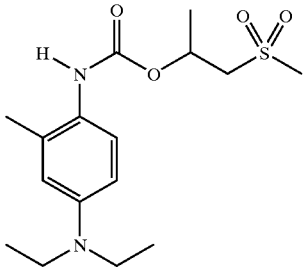
D-11
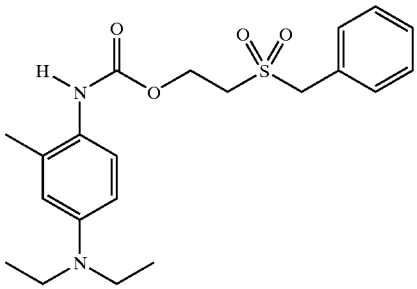

-continued
D-12
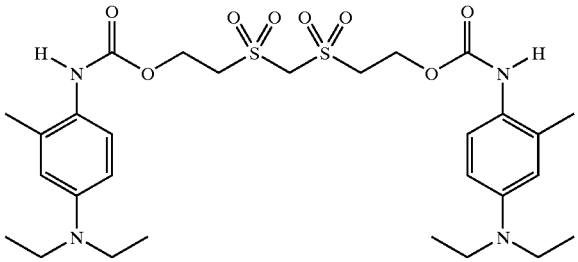
D-13
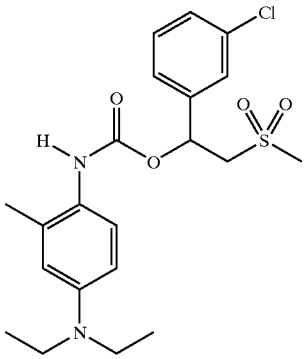
D-14
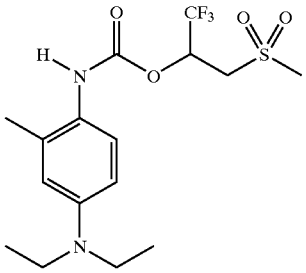
D-15
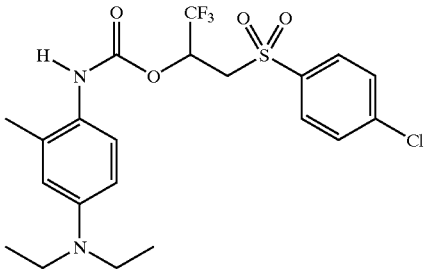
D-16
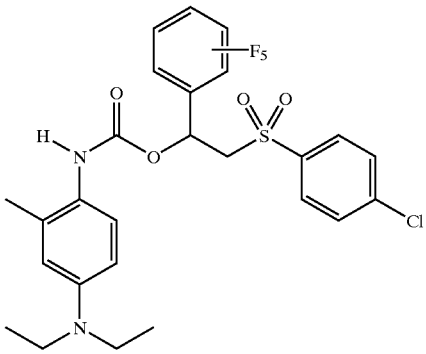
-continued
D-17
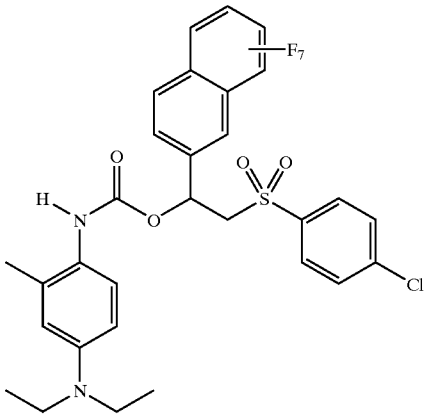
D-18
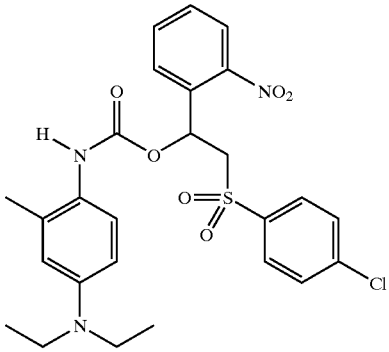
D-19
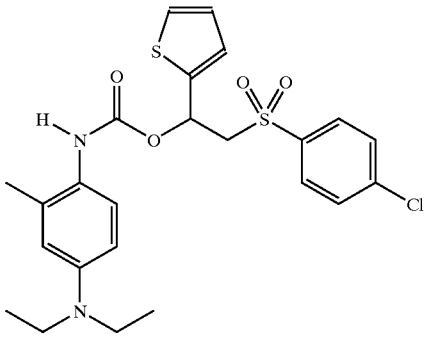
D-20
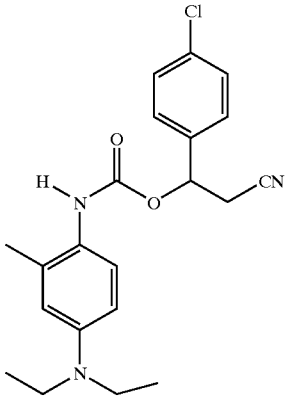

-continued
D-21
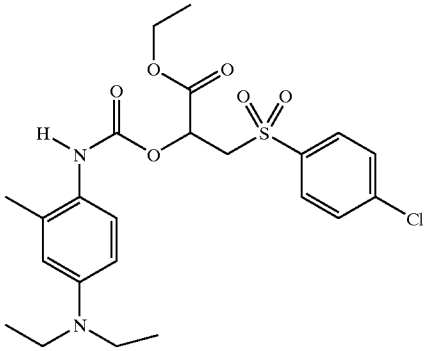
D-22
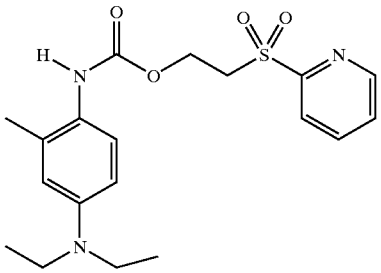
D-23
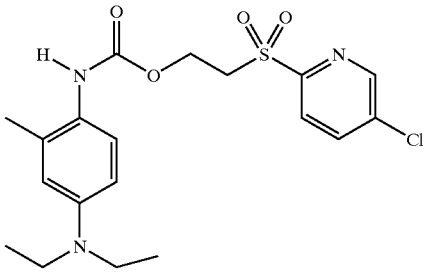
D-24
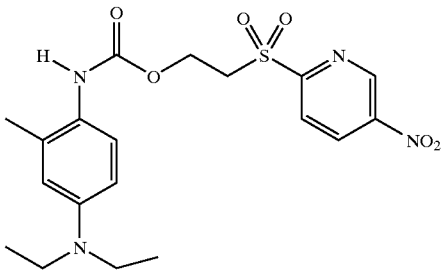
D-25
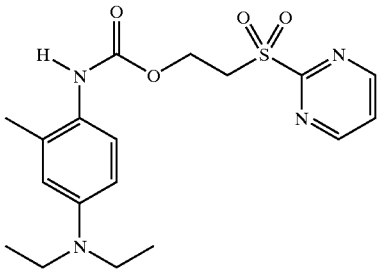
-continued
D-26
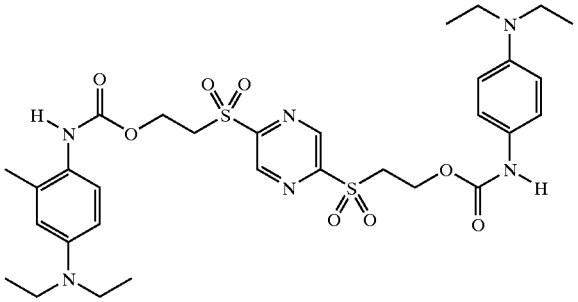
D-27
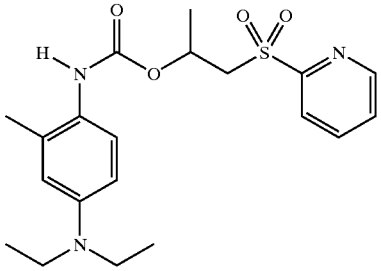
D-28
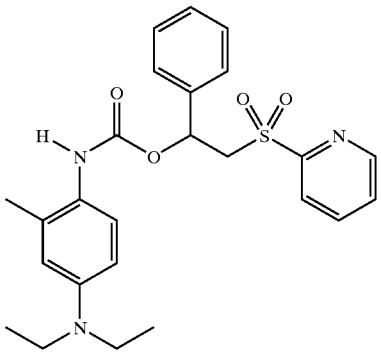
D-29
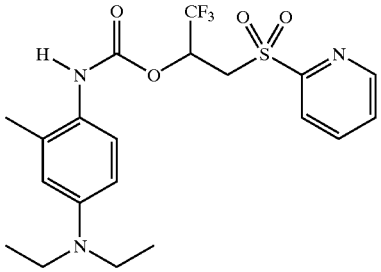
D-30
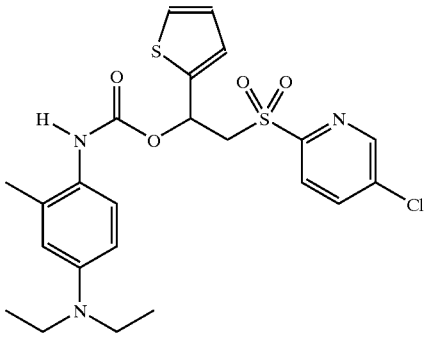

-continued
D-31
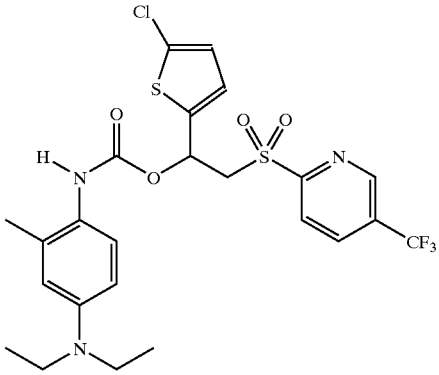
D-32
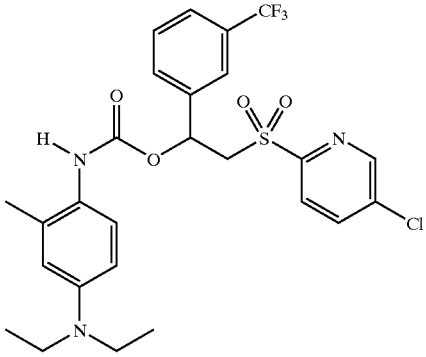
D-33
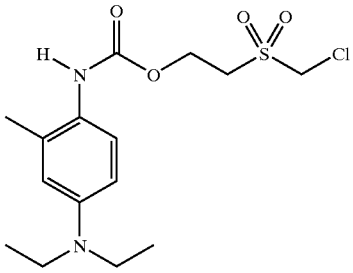
D-34
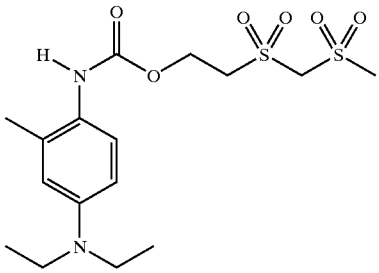
D-35
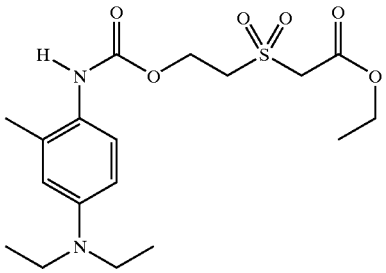
-continued
D-36
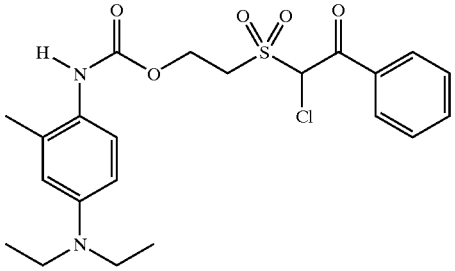
D-37
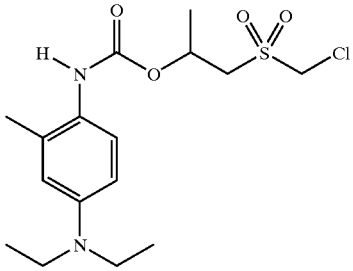
D-38
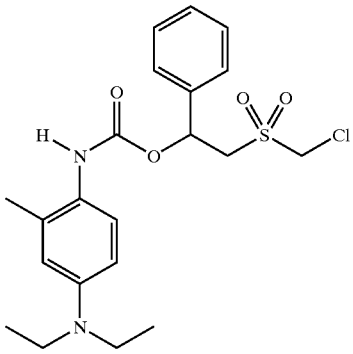
D-39
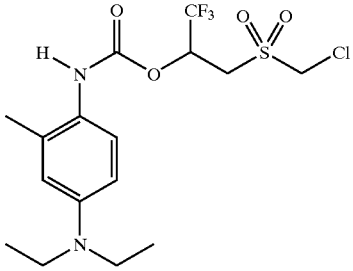
D-40
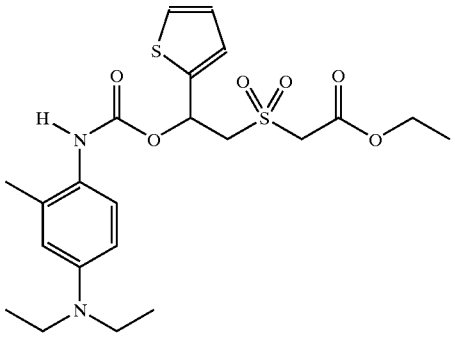

-continued

D-41

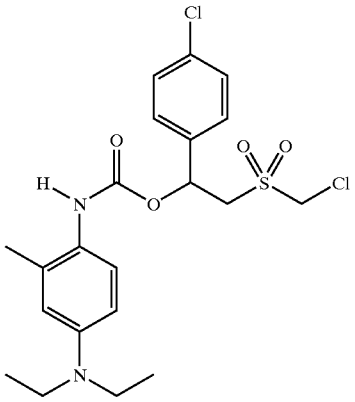

D-42

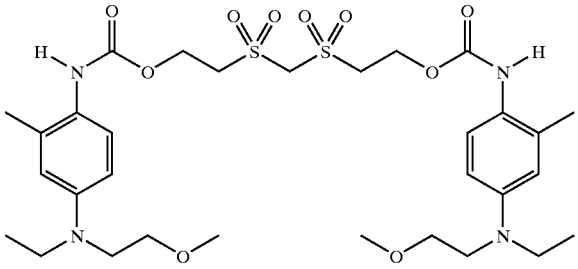

D-43

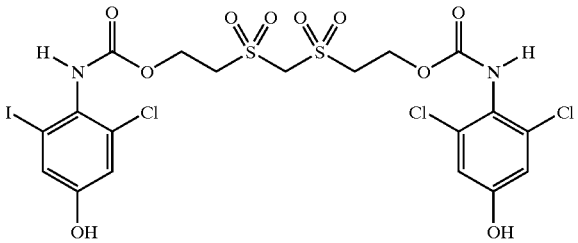

D-44

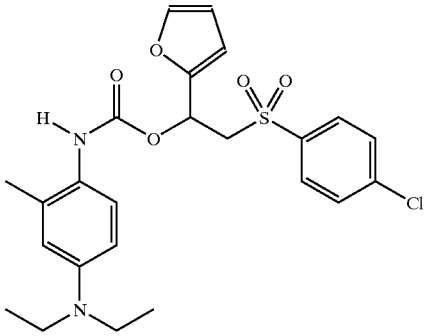

D-45

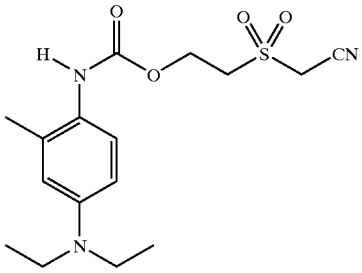

In another preferred embodiment of the present invention, either blocked developer A or blocked developer B may have the general structure shown in Structure III:

III

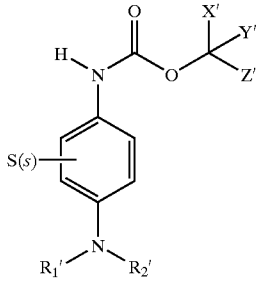

where:

$R_1'$ and $R_2'$ are independently hydrogen or an alkyl group, which may be further substituted, or $R_1'$ and $R_2'$ may join to form a heterocyclic ring;

S represents s independently selected substituents selected from the group consisting of halogen, hydroxy, amino, alkoxy, carbonamido, sulfonamido, alkylsulfonamido or alkyl, any of which may be further substituted or S substituents that are ortho to the $NR_1'R_2'$ substituent can form a heterocyclic ring with $P_1$ or $P_2$; and s is 0 to 4;

X', Y', and Z' represent substituents selected independently from the groups hydrogen, alkyl group of 1 to 6 carbon atoms, cyclopropyl, aryl, arylalkyl, and heterocyclic groups. The cyclopropyl group may be further substituted with an alkyl group of 1 to 6 carbon atoms. The aryl and heterocyclic groups may be in turn substituted with the following substituents: halogen, alkyl of 1 to 6 carbon atoms, aryl, arylalkyl, alkoxy, aryloxy, arylalkyloxy, alkylthio, arylthio, arylalkylthio, N,N-dialkylamino, N,N-diarylamino, N,N-diarylalkylamino, N-alkyl-N-arylamino, N-alkyl-N-arylalkylamino, and N-aryl-N-arylalkylamino.

In a preferred embodiment, when cyclopropyl, aryl or heterocyclic groups are not chosen as X', Y' or Z', then all three groups must be selected from among alkyl or arylalkyl groups. Additionally, two members of the X', Y', and Z' set can join to form a ring. Typically, the aryl group is represented by phenyl, 1-naphthyl, 2-naphthyl, and 9-anthracyl groups while the heterocyclic group is best represented by 2-furyl, 3-furyl, 2-thienyl, 3-thienyl, 2-pyrrolyl, 3-pyrrolyl, 2-thiazolyl, 2-benzothienyl, 3-benzothienyl, 2-indolyl, and 3-indolyl.

The following are representative examples of blocked developer compounds of Structure III for use in the invention:

D-46

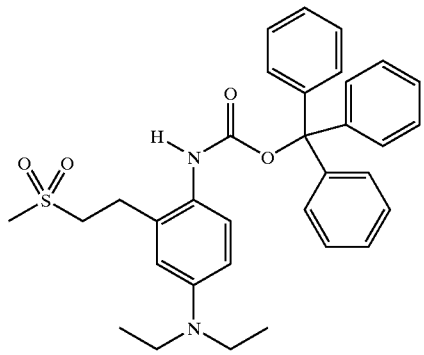

-continued
D-47
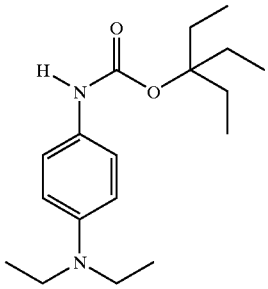
D-48
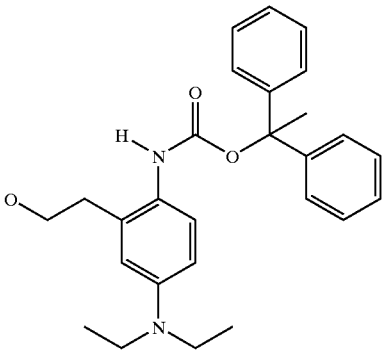
D-49
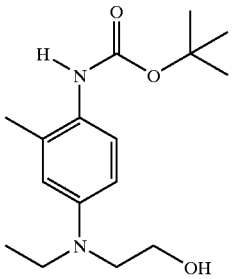
D-50
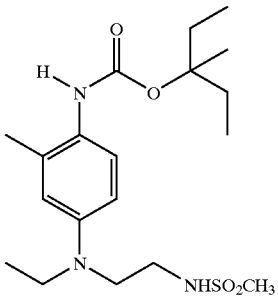
D-51
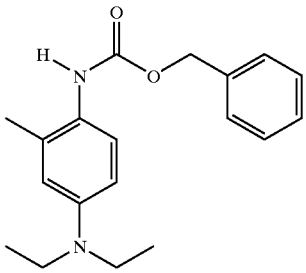
-continued
D-52
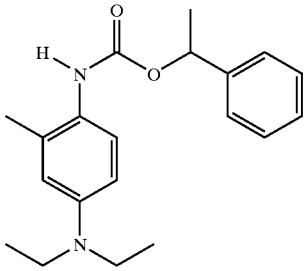
D-53
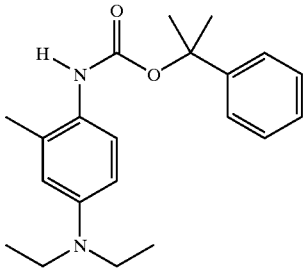
D-54
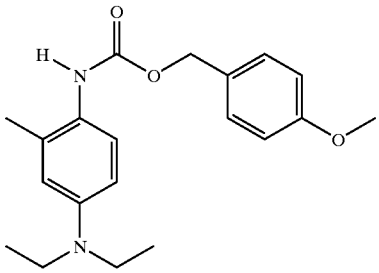
D-55
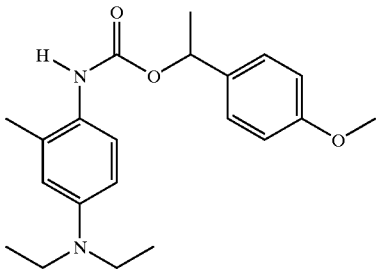
D-56
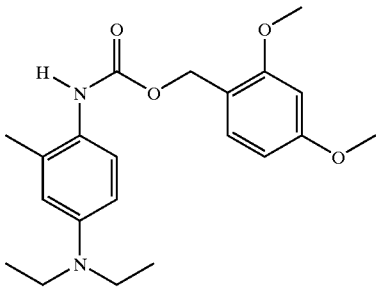

-continued
D-57
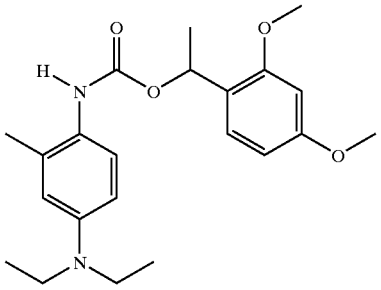
D-58
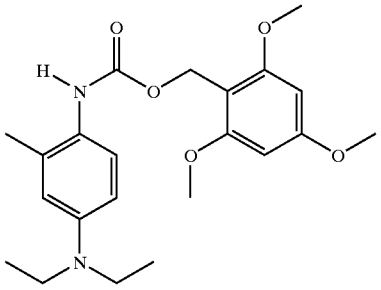
D-59
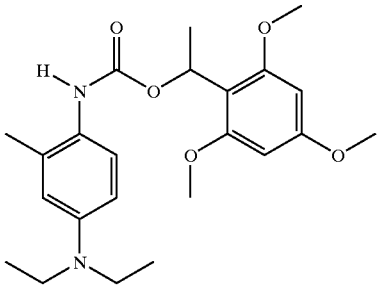
D-60
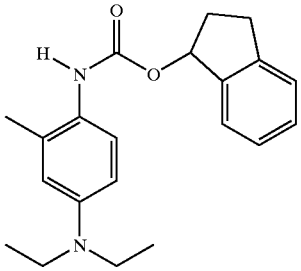
D-61
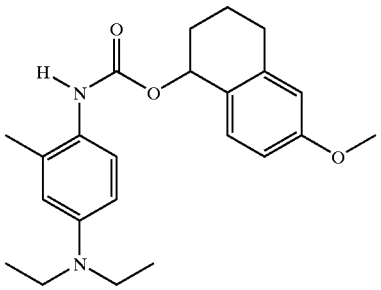
-continued
D-62
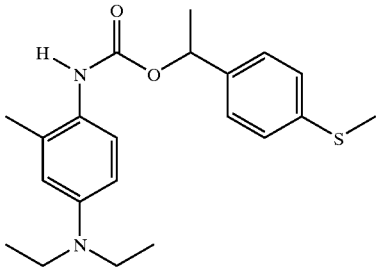
D-63
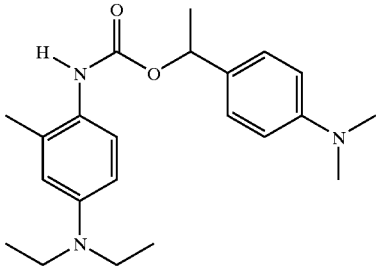
D-64
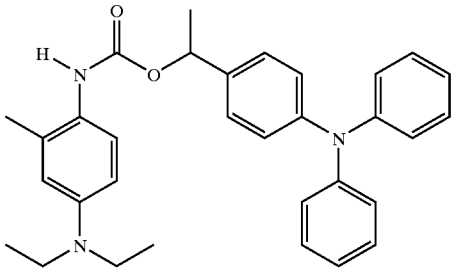
D-65
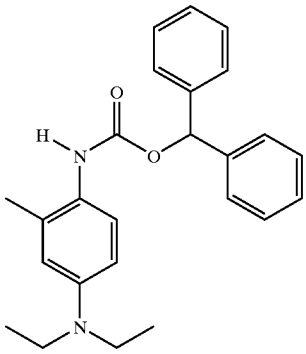
D-66
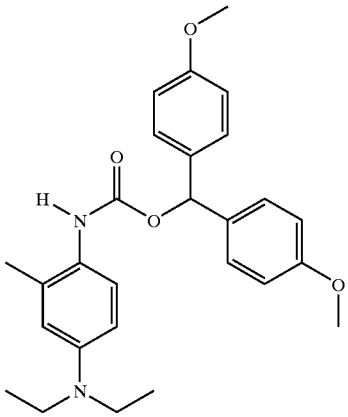

-continued
D-67
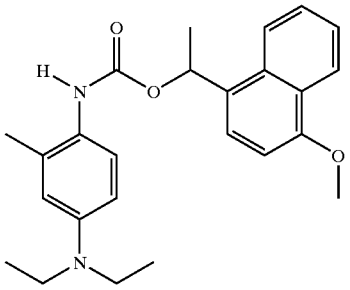
D-68
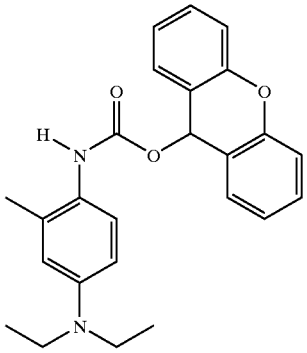
D-69
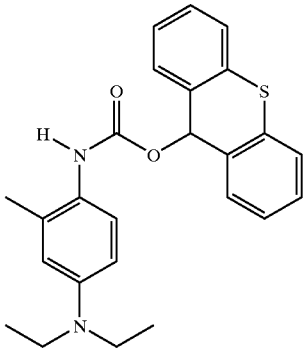
D-70
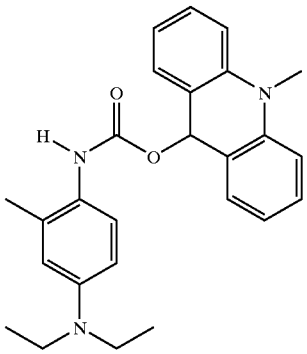
-continued
D-71
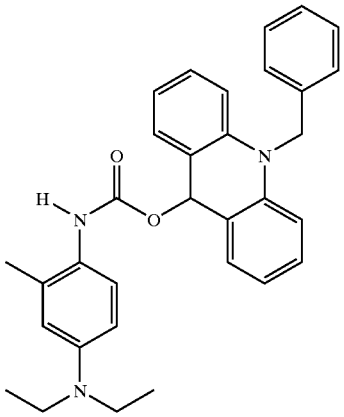
D-72
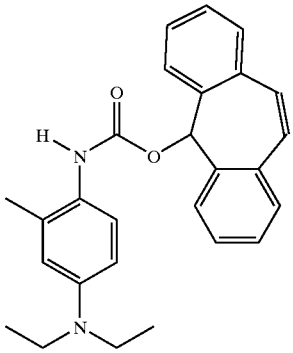
D-73
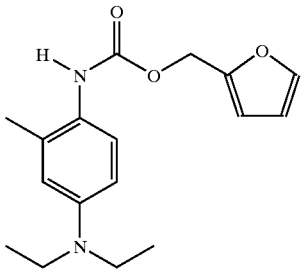
D-74
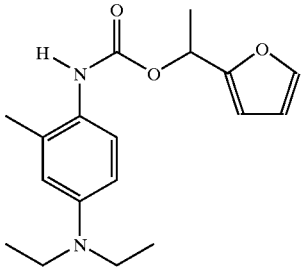
D-75
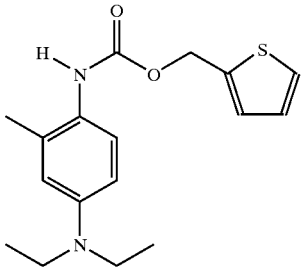

-continued
D-76
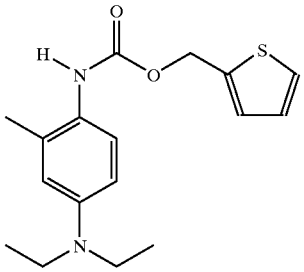
D-77
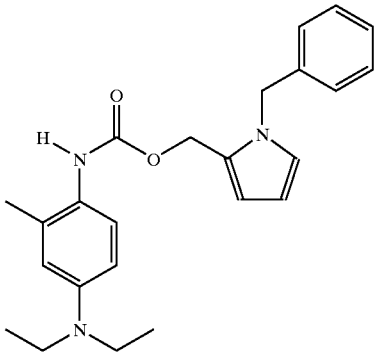
D-78
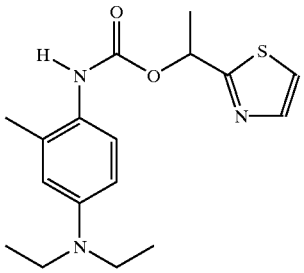
D-79
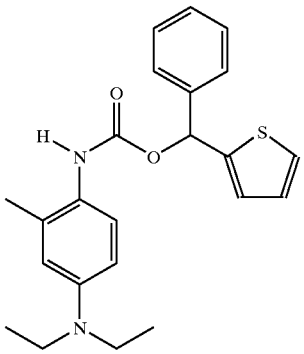
-continued
D-80
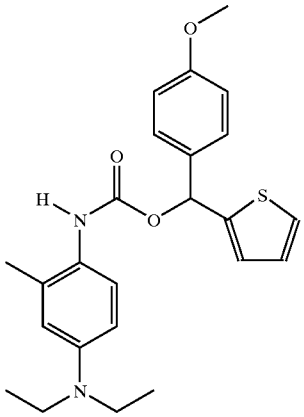
D-81
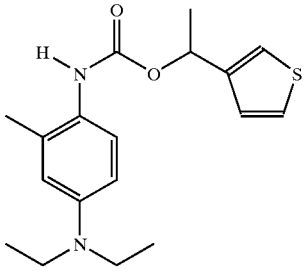
D-82
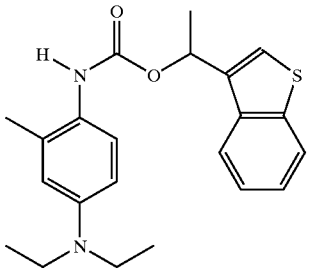
D-83
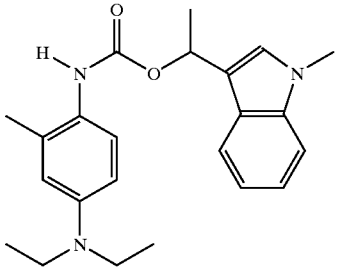
D-84
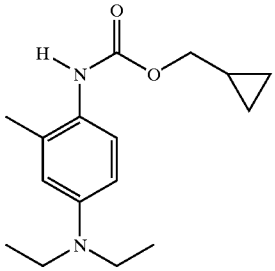

-continued
D-85
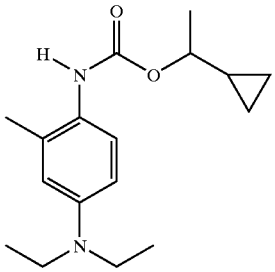
D-86
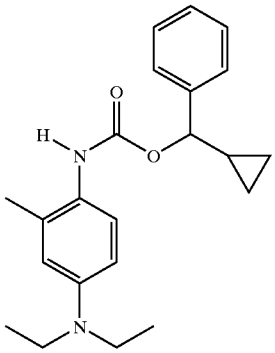
D-87
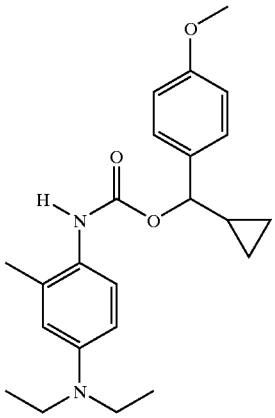
D-88
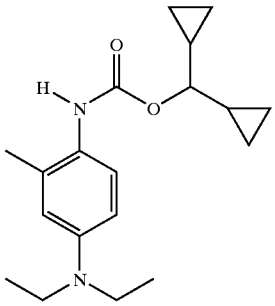
-continued
D-89
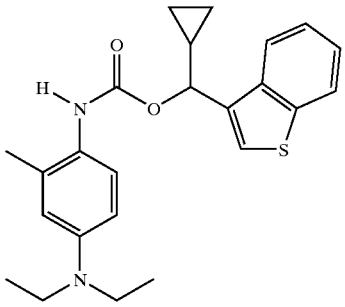
D-90
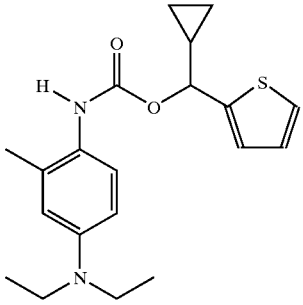
D-91
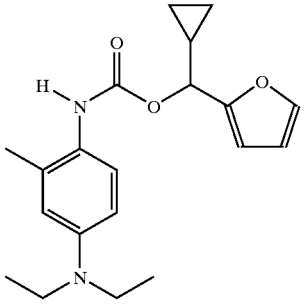
D-92
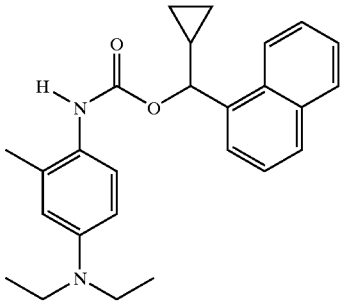
D-93
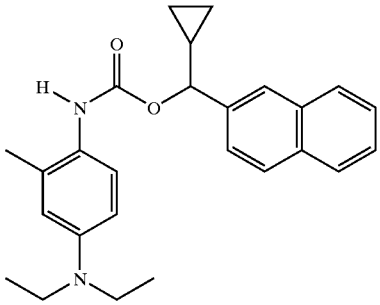

-continued
D-94
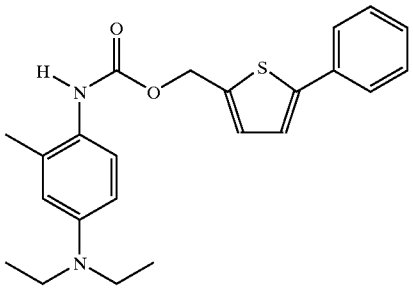
D-95
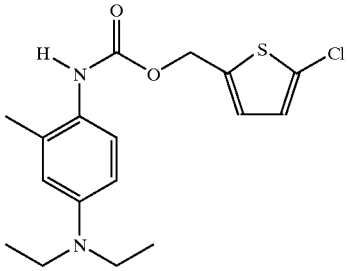
D-96
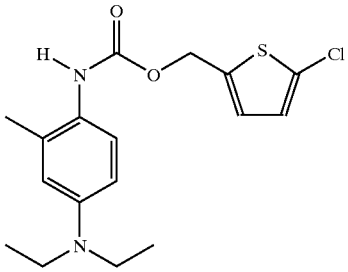
D-97
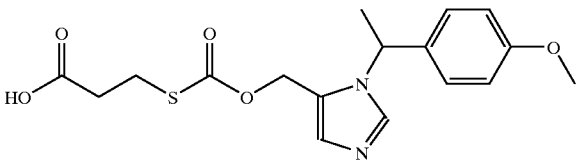
D-98
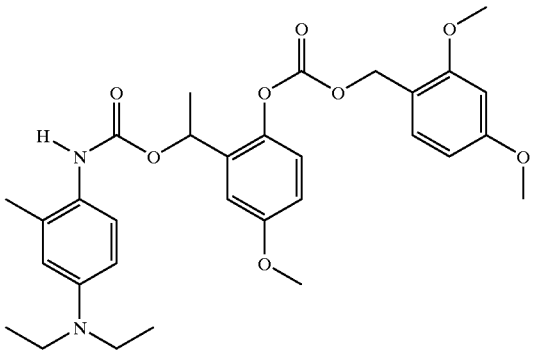
-continued
D-99
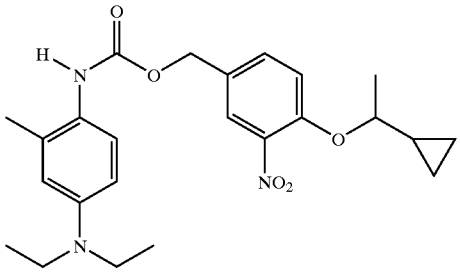
D-100
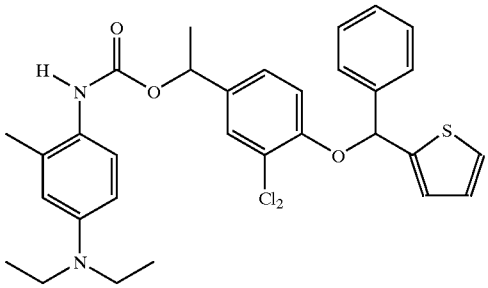
D-101
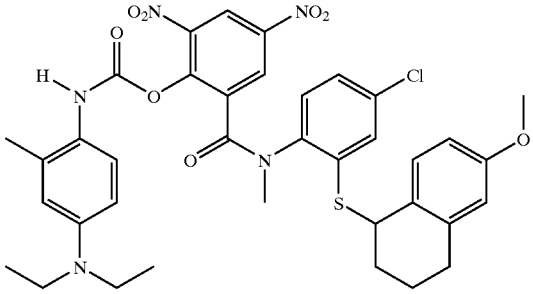
D-102
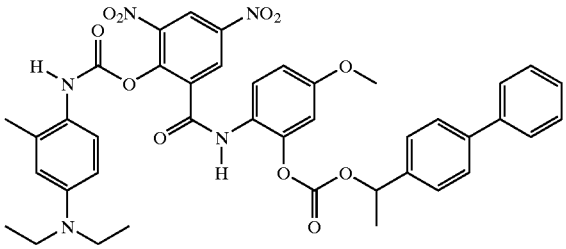
D-103
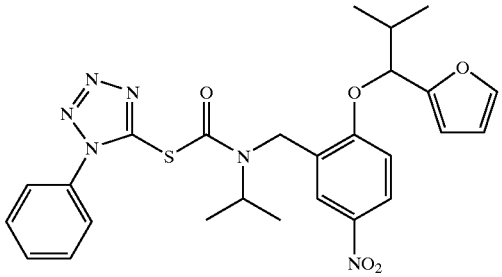

In another embodiment of the invention, both Blocked Developers A and B fall within the scope of Structure II or IIB above.

In another embodiment of the present invention, a Blocked Developer A or Blocked Developer B has a blocking group comprising a disubstituted nitrogen (NIT), for example a substituted or unsubstituted benzimidazolyl, benzothiazolyl, benzoxazolyl, benzothiophenyl,benzofuryl, furyl, imidazolyl, indazolyl, indolyl, isoquinolyl, isothiazolyl, isoxazolyl, oxazolyl, picolinyl, purinyl, pyranyl, pyrazinyl, pyrazolyl, pyridyl, pynrmidinyl, pyrrolyl, quinaldinyl, quinazolinyl, quinolyl, quinoxalinyl, tetrazolyl, thiadiazolyl, thiatriazolyl, thiazolyl, thiophenyl, triazolyl, diphenylamino and carbazolyl group. Particularly preferred are: 1-imidazolyl, 1-benzimidazolyl, 1-pyrrolyl, 1-indolyl, 1-carbazolyl, 1-pyrazolyl, 1-indazolyl, N,N-diarylamino, and 1-tetrahydrocarbazolyl. The heterocyclic group may be further substituted. Preferred substituents are alkyl and alkoxy groups containing 1 to 6 carbon atoms.

In one referred embodiment of the invention, the photographic element comprising an imaging layer having in association therewith a blocked developer of Structure IV:

V

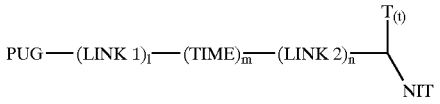

wherein

PUG is a photographically useful group;

LINK 1 and LINK 2 are first and second linking groups adjacent, respectively the timing group and the blocking group;

TIME is a timing group;

T represents t independently selected substituted or unsubstituted alkyl (preferably containing 1 to 6 carbon atoms) or aryl groups (preferably phenyl or naphthyl), t is 0, 1, or 2 and if t is 2, the T groups can form a ring;

NIT is a disubstituted nitrogen group which optionally can form a ring system with a T group;

l is 0 or 1;

m is 0, 1, or 2; and n is 0 or 1.

It will be observed that the Blocked Developer of Structure V is according to Structure I with the M group having the following Structure IVA:

IVA

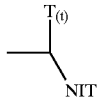

wherein

T represents t independently selected substituted or unsubstituted alkyl or aryl groups, t is 0, 1, or 2 and if t is 2, the T groups can form a ring; and NIT is a disubstituted nitrogen group which optionally can form a ring.

Particularly preferred photographically useful compounds of the class of blocked developing agents according to Structure IV have the following Structure IVB:

IVB

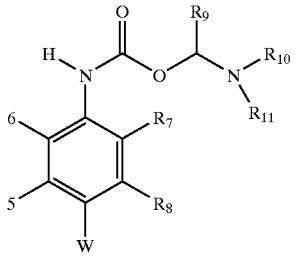

wherein:

W is OH or $NR_2R_3$, and $R_2$ and $R_3$ are independently hydrogen or a substituted or unsubstituted alkyl group or $R_2$ and $R_3$ are connected to form a ring;

$R_5$, $R_6$, $R_7$, and $R_8$ are independently hydrogen, halogen, hydroxy, amino, alkoxy, carbonamido, sulfonamido, alkylsulfonamido or alkyl, or $R_5$ can connect with $R_3$ or $R_6$ and/or $R_8$ can connect to $R_2$ or $R_7$ to form a ring;

T is hydrogen, alkyl, aryl, heteroaromatic or alkoxy groups, —$NO_2$, —CN, an electron withdrawing group substituted by $R_{13}$(—$SO_2R_{13}$, —$OSO_2R_{13}$, —$N(SO_2)R_{13}$, —$CO_2R_{13}$, —$CCl_2R_{13}$, —$N(C{=}O)R_{13}$, etc; or when T is a divalent group it can combine with $R_{10}$ or $R_{11}$ to form a ring. Preferably, T is an electron withdrawing group, including alkyl groups or aryl groups substituted with one to seven electron withdrawing groups.

$R_{10}$ and $R_{11}$ are independently alkyl, aryl, substituted aryl or heteroaromatic substituents which can be connected to form a ring system with the nitrogen atom that is a heteroaromatic or saturated or unsaturated heterocyclic ring and which may optionally contain additional heteroatoms.

In another embodiment of the present invention, both blocked developers have Structure III or IIIB above. In yet another embodiment of the invention, only one of the blocked developer have Structure III and another blocked developer has Structure IV or IVB.

When reference in this application is made to a particular moiety, or group, this means that the moiety may itself be unsubstituted or substituted with one or more substituents (up to the maximum possible number). For example, "alkyl" or "alkyl group" refers to a substituted or unsubstituted alkyl, while "aryl group" refers to a substituted or unsubstituted benzene (with up to five substituents) or higher aromatic systems, "heteroaromatic group" refers to a substituted or unsubstituted heteroaromatic (with up to five substituents), and heterocyclic group refers to a substituted or unsubstituted heterocyclic (with up to five substitutuents). Generally, unless otherwise specifically stated, substituent groups usable on molecules herein include any groups, whether substituted or unsubstituted, which do not destroy properties necessary for the photographic utility. Examples of substituents on any of the mentioned groups can include known substituents, such as: halogen, for example, chloro, fluoro, bromo, iodo; alkoxy, particularly those "lower alkyl" (that is, with 1 to 6 carbon atoms), for example, methoxy, ethoxy; substituted or unsubstituted alkyl, particularly lower alkyl (for example, methyl, trifluoromethyl); thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); acid or acid salt groups such as any of those described below; and others known in the art. Alkyl substituents may specifically include "lower alkyl" (that is, having 1–6 carbon atoms), for example, methyl, ethyl, and the like. Further, with regard to any alkyl group or alkylene group or, it will be understood that these can be branched, unbranched or cyclic.

The following are representative examples of Blocked Developer A Compounds of Structure IIIB:

D-1

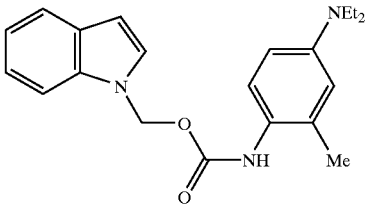

D-3

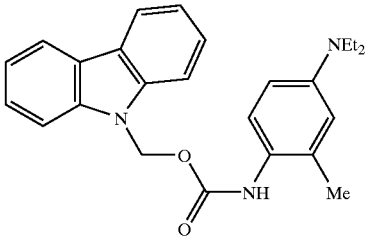

D-4

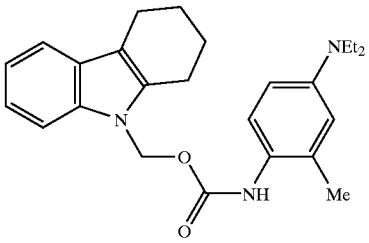

D-4

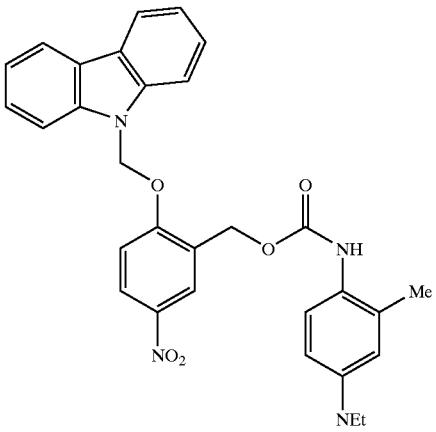

-continued

D-5

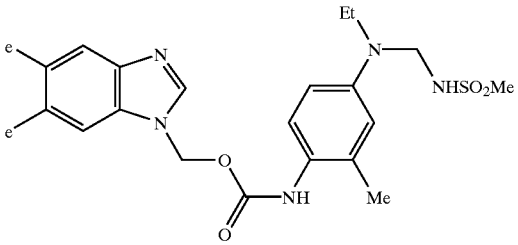

D-7

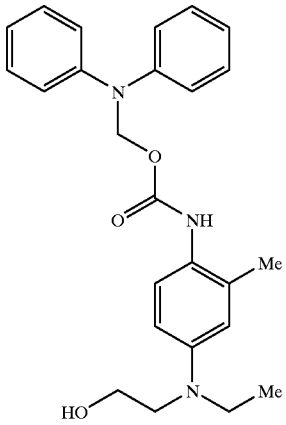

D-9

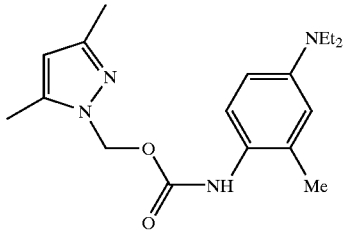

D-11

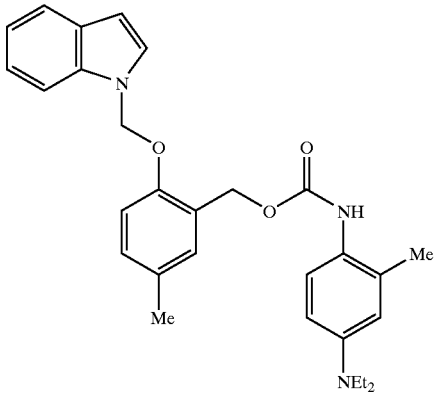

D-13

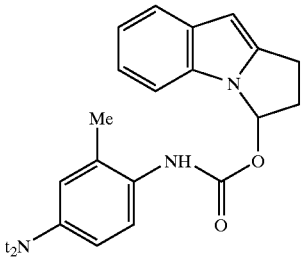

-continued

D-15

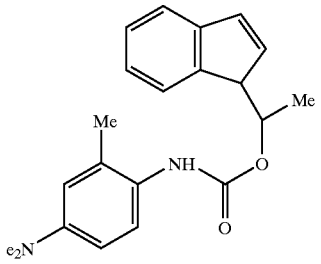

D-16

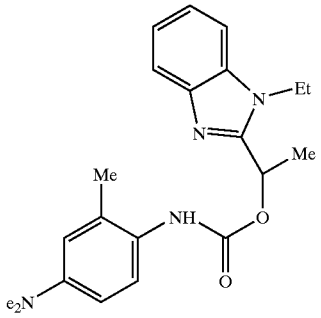

D-17

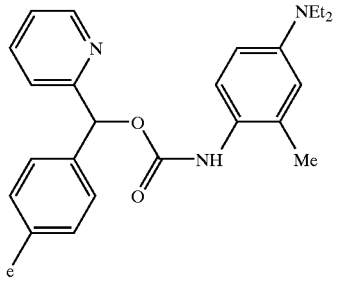

D-18

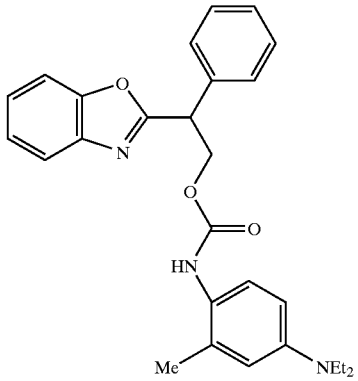

The mixture of blocked developer is preferably incorporated in one or more of the imaging layers of the imaging element. Preferably, the same mixture is used in all the imaging layers, in the same or different proportions. Alternatively, a mixture may only be present in one or some, but not all, of the imaging layers, different mixtures of blocked developers may be used in different imaging layers .See commonly assigned U.S. Ser. No. 60/211,452, hereby incorporated by reference in its entirety.

The amount of each blocked developer used is preferably 0.01 to 5 g/m$^2$, more preferably 0.1 to 2 g/m$^2$ and most preferably 0.3 to 2 g/m$^2$ in each layer to which it is added. These may be color forming or non-color forming layers of the element. The blocked developer can be contained in a separate element that is contacted to the photographic element during processing.

As indicated above, the onset temperature of Developing Agent A is less than the onset temperature of Developing Agent B, the onset temperature of Developing Agent A is in the range of 110 to 160° C., preferably 110 to 150° C. and the onset temperature of Developing Agent B is 130 to 170° C. and the difference in the onset temperatures of the two developing agents are 5 to 50° C., preferably 8 to 40° C., more preferably 10 to 30° C. In one embodiment of the invention, the at least two developing agents comprise at least two developing agents of Structure II, preferably Structure IIB. In another embodiment of the invention, the at least two developing agents comprise at least one developing agent of Structure II, preferably Structure IIB and at least one developing agent of Structure III or Structure V.

After image-wise exposure of the imaging element, the mixture of blocked developers is activated during processing of the imaging element by the presence of acid or base in the processing solution, by heating the imaging element during processing of the imaging element, and/or by placing the imaging element in contact with a separate element, such as a laminate sheet, during processing. The laminate sheet optionally contains additional processing chemicals such as those disclosed in Sections XIX and XX of *Research Disclosure*, September 1996, Number 389, Item 38957 (hereafter referred to as ("*Research Disclosure I*"). All sections referred to herein are sections of *Research Disclosure I*, unless otherwise indicated. Such chemicals include, for example, sulfites, hydroxyl amine, hydroxamic acids and the like, antifoggants, such as alkali metal halides, nitrogen containing heterocyclic compounds, and the like, sequestering agents such as an organic acids, and other additives such as buffering agents, sulfonated polystyrene, stain reducing agents, biocides, desilvering agents, stabilizers and the like.

EXAMPLE 1

This example illustrates the preparation of a Blocked Developer B (referred to as compound D-3) that can be used in the present invention, which blocked developer is represented by the following structure:

D-105

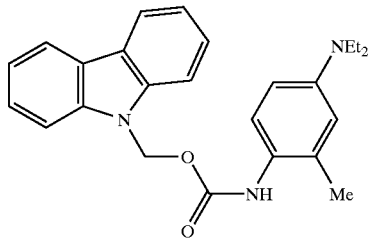

Compound D-105 is prepared according to the following reaction scheme, starting with compound a.

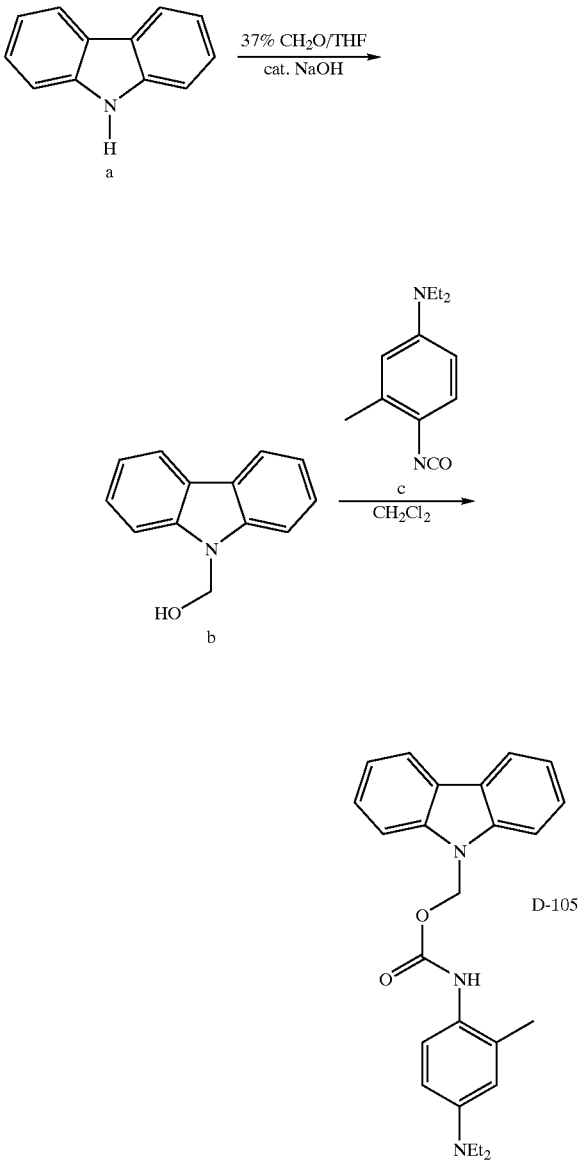

Preparation of Compound (b)

To a mixture of a (16.72 g, 100 mmol), TBF (120 mL) were added 37% aqueous solution of formalin (13 mL) and two drops of 50% NaOH. The reaction mixture was stirred at room temperature for 8 hours and poured into water (650 mL). The solid material was isolated by filtration to give 18.11 g (92%) of the b.

Preparation of Compound (D-105)

To a mixture of b (9.87 g, 10 mmol), methylene chloride (40 mL), and two drops of dibutyltin diacetate was added c (10.81 g, 52 mol). After being stirred at room temperature for 14 hours, the reaction mixture was concentrated under reduced pressure and diluted with the mixture of ligroin and ethyl acetate (4:1). The solid material was isolated by filtration to give 17.84 g (89%) of D-105, $^1$H NMR (300 MHz, $CDCl_3$): 1.11 (t, J=7.3 Hz, 6H), 2.10 (s, 3H), 3.27 (q, J=7.3 Hz, 4H), 6.12 (s, 1H), 6.28–6.59 (m, 4H), 7.15–7.35 (m, 3H), 7.39–7.56 (m, 2H), 7.42–7.55 (t, 2H), 7.65–7.74 (d, 2H), 8.06 (d, 2H).

EXAMPLE 2

This example illustrates the synthesis of a representative Blocked Developer A useful in the invention. This compound is referred to above as blocked developing agent D-10, and is prepared according to the following reaction scheme:

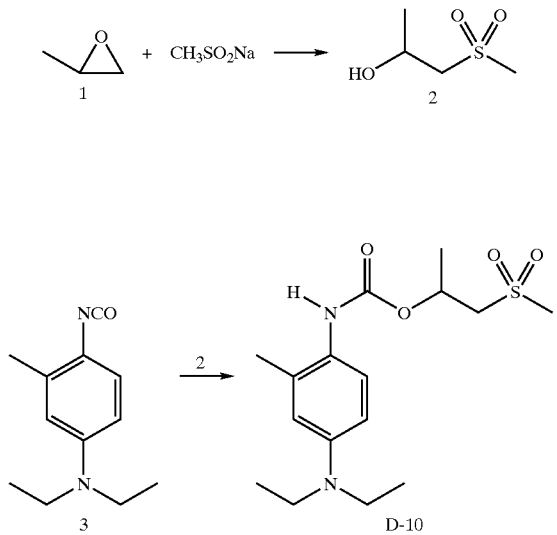

Propylene oxide (1, 7.2 mL, 105 mmol), sodium methanesulfinate (9.19 g, 90 mmol), and monobasic sodium phosphate monohydrate (16.56 g) were heated in 100 mL of water at 90° C. for 18 h. The solution was cooled and extracted with 4×100 mL of ethyl acetate. The extracts were dried over sodium sulfate and concentrated to a solid. The yield of 2 was 6.42 g (46 mmol, 52%).

A solution of 2 (3.32 g, 24 mmol), compound 3 (4.08 g, 20 mmol), and dibutyltin diacetate (0.05 mL) in 60 mL of 1,2-dichloroethane was stirred at room temperature for 7 days. The crude reaction mixture was purified by column chromatography on silica gel. The yield of D-10 was 6.15 g (18 mmol, 90%), m.p. 80–82° C., ESMS: ES+m/z 343 (M+1, 100%).

EXAMPLE 3

A representative synthesis blocked developers of Structure III of the invention is described below.

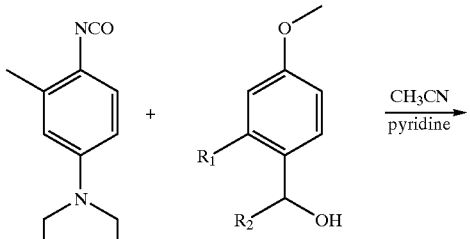

1

2a ($R_1$ = $OCH_3$, $R_2$ = H)
2b ($R_1$ = H, $R_2$ = $CH_3$)

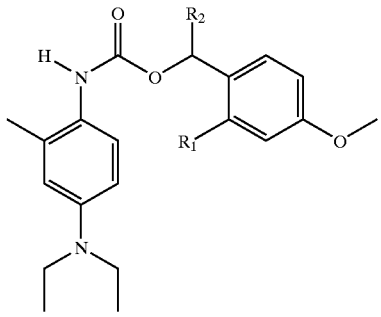

D-56 ($R_1$ = $OCH_3$, $R_2$ = H)
D-55 ($R_1$ = H, $R_2$ = $CH_3$)

Preparation of D-56

A solution of 1 (2.04 g, 10 mmol), 2a (1.83 g, 12 mmol) and pyridine (0.1 mL) in acetonitrile (25 mL) was refluxed for 18 h. The mixture was cooled, filtered and concentrated in vacuo. The crude product was purified by column chromatography, giving 1.89 g (5.3 mmol, 53%) of D-56, m.p. 90–92° C., APMS: AP+ m/z 357 (M+1, 75%).

Preparation of D-55.

Prepared as described for D-56 from 1 and 2b. The yield: 62%, m.p. 90–91° C., ESMS: ES+ m/z 373 (M+1, 100%).

EXAMPLE 4

This example illustrates the synthesis of another representative locked developer useful in the invention. This compound is referred to above as developing agent D-12, and is prepared according to the following reaction scheme:

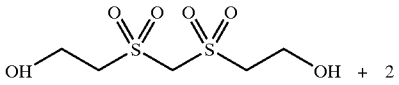

6

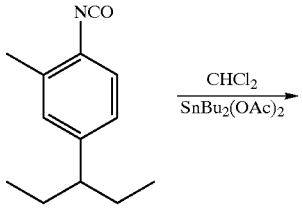

3

-continued

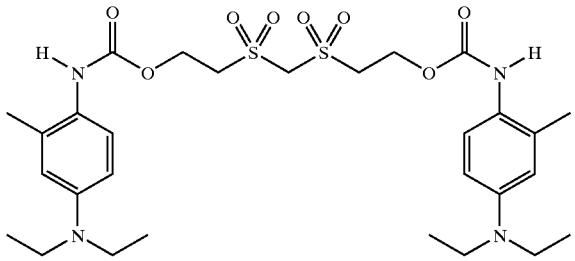

Compounds 2 and 6 are commercially available. Dibutyltin diacetate is also commercially available. The crude reaction mixture can be purified by column chromotography on silica gel. The resulting Compound BD-28 is thusly obtained in good yield.

EXAMPLE 5

This Example illustrates the performance of a compound according to the present invention in a photographic element. The processing conditions are as described below with respect to each sample. Unless otherwise stated, the silver halide was removed after development by immersion in *Kodak Flexicolor Fix* solution. In general, an increase of approximately 0.2 in the measured density would be obtained by omission of this step. The following components are used in the samples, including is a list of all of the chemical structures.

Coating Format

The inventive coating examples were prepared on a 7 mil thick poly(ethylene terephthalate) support and comprised an emulsion containing layer (contents shown below) with an overcoat layer of gelatin (0.22 g/$m^2$) and 1,1'-(methylenebis (sulfonyl))bis-ethene hardener (at 2% of the total gelatin concentration). Both layers contained spreading aids to facilitate coating.

TABLE 5-1

| Component | Laydown |
|---|---|
| Silver (from emulsion E-1) | 0.54 g/$m^2$ |
| Silver (from emulsion E-2) | 0.22 g/$m^2$ |
| Silver (from emulsion E-3) | 0.16 g/$m^2$ |
| Silver (from emulsion E-4) | 0.11 g/$m^2$ |
| Silver (from silver salt SS-1) | 0.32 g/$m^2$ |
| Silver (from silver salt SS-2) | 0.32 g/$m^2$ |
| Coupler M-1 (from coupler dispersion Disp-1) | 0.54 g/$m^2$ |
| Developer | 2.69 mMole/$m^2$ |
| Salicylanilide | 0.86 g/$m^2$ |
| Lime processed gelatin | 4.3 g/$m^2$ |

The common components in the structure were as follows:

Silver Salt Dispersion SS-1

A stirred reaction vessel was charged with 431 g of lime processed gelatin and 6569 g of distilled water. A solution containing 214 g of benzotriazole, 2150 g of distilled water, and 790 g of 2.5 molar sodium hydroxide was prepared (Solution B). The mixture in the reaction vessel was adjusted to a pAg of 7.25 and a pH of 8.00 by additions of Solution B, nitric acid, and sodium hydroxide as needed.

A 4 L solution of 0.54 molar silver nitrate was added to the kettle at 250 cc/minute, and the pAg was maintained at 7.25 by a simultaneous addition of solution B. This process was continued until the silver nitrate solution was exhausted, at which point the mixture was concentrated by ultrafiltration. The resulting silver salt dispersion contained fine particles of silver benzotriazole.

Silver Salt Dispersion SS-2

A stirred reaction vessel was charged with 431 g of lime processed gelatin and 6569 g of distilled water. A solution containing 320 g of 1-phenyl-5-mercaptotetrazole, 2044 g of distilled water, and 790 g of 2.5 molar sodium hydroxide was prepared (Solution B). The mixture in the reaction vessel was adjusted to a pAg of 7.25 and a pH of 8.00 by additions of Solution B, nitric acid, and sodium hydroxide as needed. A 4 l solution of 0.54 molar silver nitrate was added to the kettle at 250 cc/minute, and the pAg was maintained at 7.25 by a simultaneous addition of solution B. This process was continued until the silver nitrate solution was exhausted, at which point the mixture was concentrated by ultrafiltration. The resulting silver salt dispersion contained fine particles of the silver salt of 1-phenyl-5-mercaptotetrazole.

Emulsions

Silver halide emulsions were prepared by conventional means to have the following morphologies and compositions. The emulsions were spectrally sensitized to green light by addition of sensitizing dyes and then chemically sensitized for optimum performance.

E-1: a tabular emulsion with composition of 96% silver bromide and 4% silver iodide and an equivalent circular diameter of 1.2 microns and a thickness of 0.12 microns.

E-2: a tabular emulsion with composition of 98% silver bromide and 2% silver iodide and an equivalent circular diameter of 0.45 microns and a thickness of 0.006 microns.

E-3: a tabular emulsion with composition of 98% silver bromide and 2% silver iodide and an equivalent circular diameter of 0.79 microns and a thickness of 0.009 microns.

E-4: a cubic emulsion with composition of 97% silver bromide and 3% silver iodide and size of 0.16 microns.

Coupler Dispersion Disp-1

An oil based coupler dispersion was prepared containing coupler M-1, tricresyl phosphate and 2-butoxy-N,N-dibutyl-5-(1,1,3,3-tetramethylbutyl)benzenamine, at a weight ratio of 1:0.8:0.2.

Coupler M1

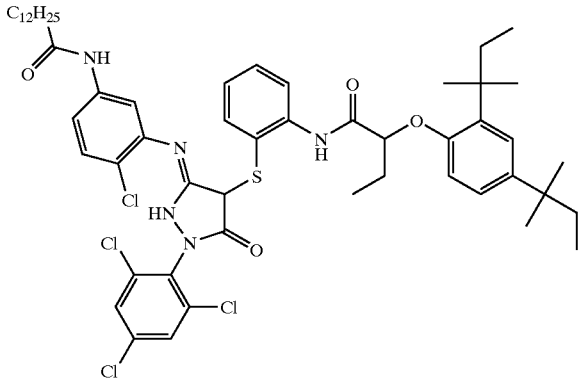

High To Developer Dev-:1

The high To incorporated developer D-12 had the following structure:

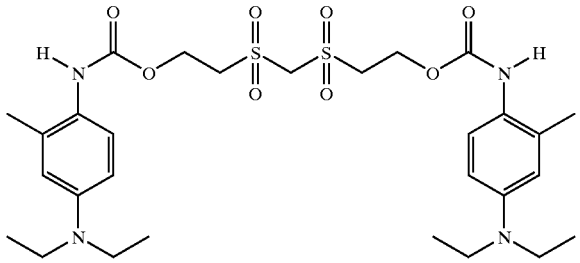

This material was ball-milled in an aqueous mixture, for 4 days using Zirconia beads in the following formula. For 1 g of Incorporated developer, sodium tri-isopropylnaphthalene sulfonate (0.1 g ), water ( to 10 g), and beads (25 ml), were used. In some cases, after milling, the slurry was diluted with warmed (40° C.) gelatin solution (12.5%, 10 g) before the beads were removed by filtration. The filtrate (with or without gelatin addition) was stored in a refrigerator prior to use.

Low to Incorporated Developer (Dev-2)

This material was incorporated in the same way as for Dev-1. The structure of the low To incorporated developer is D-104.

Coating Evaluation

The resulting coatings were exposed through a step wedge to a 3.04 log lux light source at 3000K filtered by Daylight 5A, 0.6 Inconel and Wratten 9 filters. The exposure time was 0.1 seconds. After exposure, the coating was thermally processed by contact with a heated platen for 20 seconds. A number of strips were processed at a variety of platen temperatures in order to check the generality of the effects that were seen. Density measurements were made at each step and from these data, two parameters were obtained:

A. Onset Temperature, $T_o$: Corresponds the temperature required to produce a maximum density (Dmax) of 0.5. Lower temperatures indicate more active developers which are desirable.

B. Peak Discrimination, $D_P$: For the optimum platen temperature, the peak discrimination corresponds to the value:

$$D_p = \frac{D_{max} - D_{min}}{D_{min}}$$

High values of $D_P$ indicate the developer produces good signal to noise, which is desirable.

The coatings shown above performed as shown in the Table 5-2 below.

TABLE 5-2

| Coating | Developer | $T_O$ (° C.) | $D_P$ |
|---|---|---|---|
| I-1 | Dev-1 | 135 | 9.6 |
| I-2 | 80% Dev-1 + 20% Dev-2 | 116 | 5.0 |
| I-3 | Dev-2 | 110 | 2.0 |

These data show that by incorporating Dev-2 into coatings containing Dev-1, the onset temperature can be greatly reduced (by 19° C.) while maintaining a good peak discrimination.

EXAMPLE 6

This used a similar coating structure and similar components to those in Example 6 with the following changes: The emulsions were spectrally sensitized to blue light by addition of sensitizing dyes and then chemically sensitized for optimum performance.

E-5 replaced E-1: and was a tabular emulsion with composition of 98% silver bromide and 2% silver iodide and an equivalent circular diameter of 1.2 microns and a thickness of 0.12 microns.

E-6 replaced E-2: and was a tabular emulsion with composition of 98% silver bromide and 2% silver iodide and an equivalent circular diameter of 0.45 microns and a thickness of 0.006 microns.

E-7 replaced E-3: and was a tabular emulsion with composition of 98% silver bromide and 2% silver iodide and an equivalent circular diameter of 0.79 microns and a thickness of 0.009 microns.

E-8 replaced E-4: and was a cubic emulsion with composition of 97% silver bromide and 3% silver iodide and size of 0.16 microns. Salicylanilide was coated at 0.65 g/m$^2$ Coupler Y-1 replaced M-1. An oil based coupler dispersion was prepared containing coupler Y-1, 1,2-benzenedicarboxylic acid, dibutyl ester, at a weight ratio of 1:0.5.

Y-1

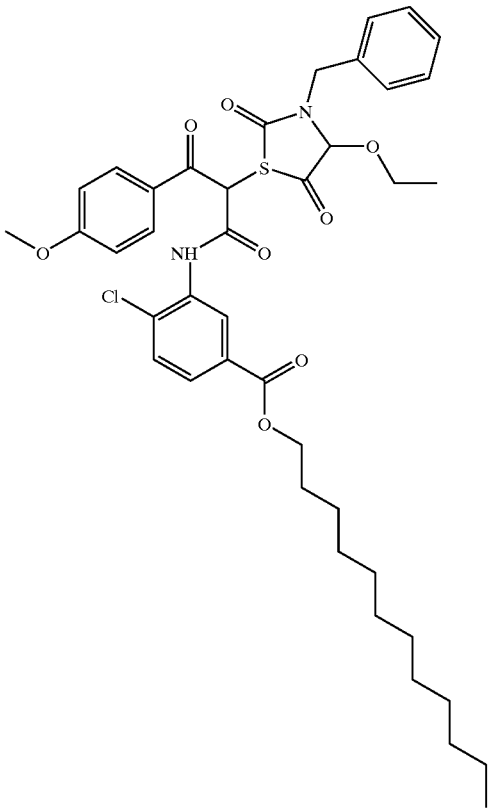

The Coating Evaluation

The resulting coatings were exposed through a step wedge to a 3.04 log lux light source at 3000K filtered by Daylight 5A, and Wratten 2B filters. The exposure time was 0.1 seconds. After exposure, the coating was thermally processed by contact with a heated platen for 20 seconds. A number of strips were processed at a variety of platen temperatures in order to check the generality of the effects that were seen. The coatings described above performed as shown in the Table 6-1 below.

TABLE 6-1

| Coating | Developer | $T_O$ (° C.) | $D_P$ |
|---|---|---|---|
| I-4 | Dev-1 | 141 | 7.7 |
| I-5 | 90% Dev-1 + 10% Dev-2 | 137 | 5.1 |
| I-6 | 80% Dev-1 + 20% Dev-2 | 135 | 4.1 |
| I-7 | 50% Dev-1 + 50% Dev-2 | 131 | 3.7 |
| I-8 | Dev-2 | 122 | 2.5 |

Difference is 5.2

The reduction in onset temperature with increasing level of Dev-2 can be seen. In particular, a decrease in 10° C. is obtained by using 50% of Dev-2.

EXAMPLE 7

The following components were used in the creation of the sample photographic element of this example:

Silver Salt Dispersion SS-1

A stirred reaction vessel was charged with 431 g of lime processed gelatin and 6569 g of distilled water. A solution containing 214 g of benzotriazole, 2150 g of distilled water, and 790 g of 2.5 molar sodium hydroxide was prepared (Solution B). The mixture in the reaction vessel was adjusted to a pAg of 7.25 and a pH of 8.00 by additions of Solution B, nitric acid, and sodium hydroxide as needed. A 4 l solution of 0.54 molar silver nitrate was added to the kettle at 250 cc/minute, and the pAg was maintained at 7.25 by a simultaneous addition of solution B. This process was continued until the silver nitrate solution was exhausted, at which point the mixture was concentrated by ultrafiltration. The resulting silver salt dispersion contained fine particles of silver benzotriazole.

Emulsion E-1

A silver halide tabular emulsion was precipitated by means known in the art. The emulsion contained 98% silver bromide and 2% silver iodide, and had dimensions of 1.2 microns in effective circular diameter by 0.12 microns in thickness. The emulsion was spectrally sensitized to green light by addition of dyes SM-1 and SM-2, and then was chemically sensitized to an optimum position as is known in the art.

Coupler Dispersion CDM-1

A coupler dispersion was prepared by conventional means containing coupler M-1 without any additional permanent solvents.

M-1

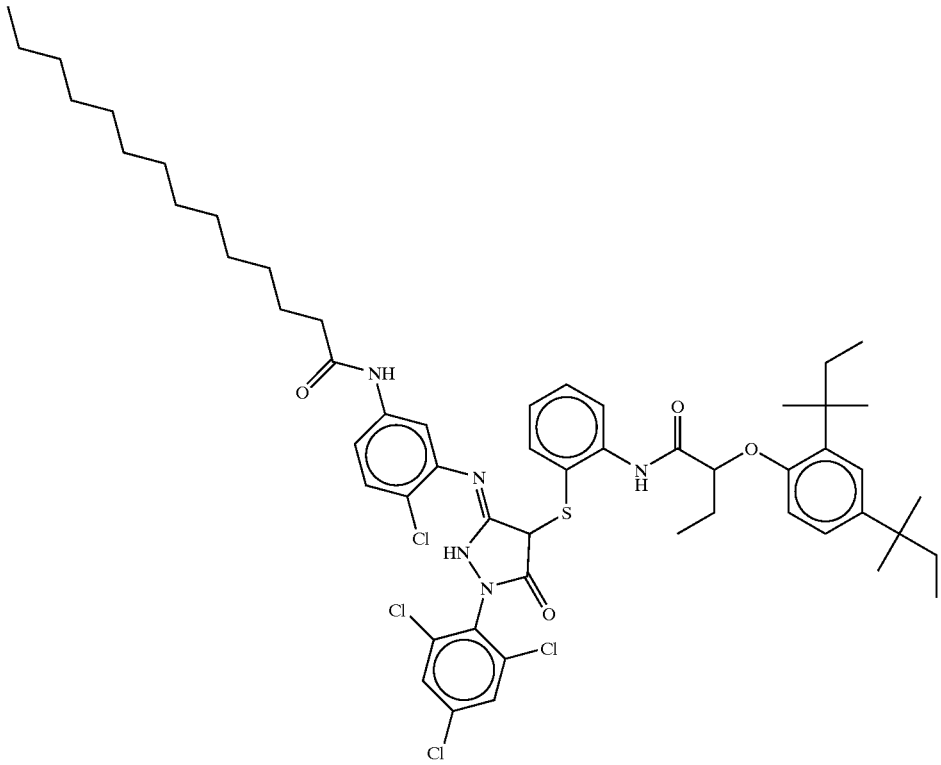

SM-1

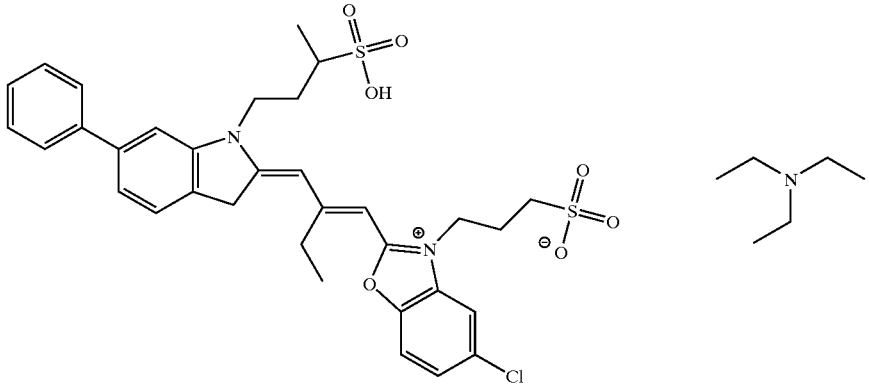

SM-2

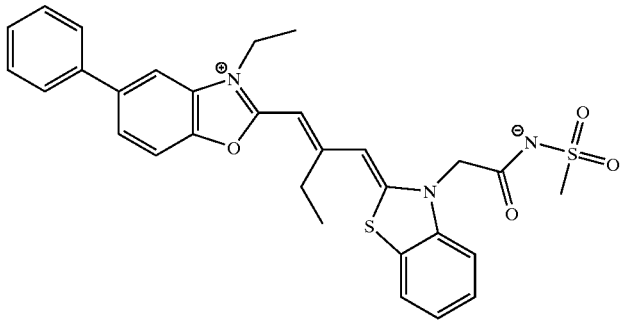

All coatings for this example contain a single light sensitive layer and were prepared according to the format listed in Table 7-1, with variations consisting of changing the incorporated developer. The total developer laydown was kept constant in all coatings at 2.21 mmols/$m^2$, while the ratio of developer types was varied. All coatings were prepared on a 7 mil thick poly(ethylene terephthalate) support.

TABLE 7-1

| Component | Laydown |
|---|---|
| Silver (from emulsion E-1) | 0.86 g/m$^2$ |
| Silver (from silver salt SS-1) | 0.32 g/m$^2$ |
| Silver (from silver salt SS-2) | 0.32 g/m$^2$ |
| Coupler M-1 (from coupler dispersion CDM-1) | 0.54 g/m$^2$ |
| Salicylanilide | 0.86 g/m$^2$ |
| Lime processed gelatin | 4.31 g/m$^2$ |

The developers listed in table 7-2 below were tested in combination. Developers were ball-milled in an aqueous slurry for 3 days using Zirconia beads in the following formula. For each gram of incorporated developer, 0.2 g of sodium tri-isopropylnaphthalene sulfonate, 10 g of water, and 25 ml of beads were added. Following milling, the zirconia beads were removed by filtration. The slurry was refrigerated prior to use.

TABLE 7-2

D-12

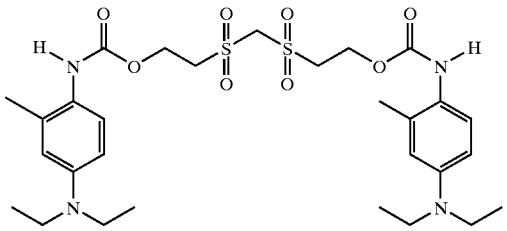

D-18

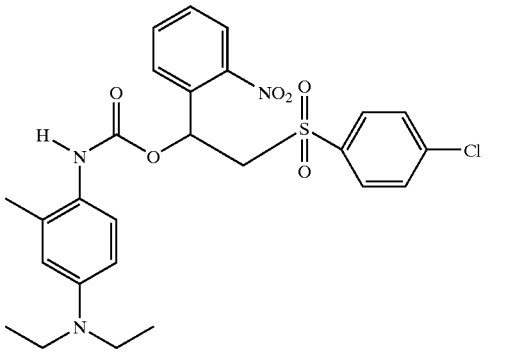

The resulting coatings were exposed through a step wedge to a 3.04 log lux light source at 3000K filtered by Daylight SA and Wratten 2B filters. The exposure time was 1 second. After exposure, the coating was thermally processed by contact with a heated platen for 20 seconds. A number of strips were processed at a variety of platen temperatures in order to yield an optimum strip process condition. From this data, two parameters were obtained:

A. Onset Temperature, $T_o$

Corresponds the temperature required to produce a maximum density (Dmax) of 0.5. Lower temperatures indicate more active developers which are desirable.

B. Peak Discrimination, $D_P$

For the optimum platen temperature, the peak discrimination corresponds to the value:

$$D_p = \frac{D_{max} - D_{min}}{D_{min}}$$

Higher values of $D_P$ indicate developers producing enhanced signal to noise, which are desirable.

Table 7-3 shows the results for the coatings used in this example.

Items listed are the percentages of each of developers D-1 and D-2, the onset temperature $T_o$, and the relative discrimination, $D_P$.

TABLE 7-3

| Coating | % D-1 | % D-2 | $T_O$ (° C.) | $D_P$ |
|---|---|---|---|---|
| 1-1 | 100 | 0 | 136.0 | 5.21 |
| 1-2 | 67 | 33 | 137.5 | 7.66 |
| 1-3 | 33 | 67 | 141.0 | 7.82 |
| 1-4 | 0 | 100 | 151.7 | 5.72 |

It can be seen by examination of Table 8-3 that the combination of blocked developers D-1 and D-2 yields onset temperatures lower than that of developer D-2 alone while providing superior image discrimination to either blocked developer alone.

EXAMPLE 8

To further illustrate the advantage of the invention, a photothermographic element was constructed on polyethyleneterephthalate support with the following components:

TABLE 8-1

| Component | Laydown |
|---|---|
| Silver (from emulsion E-2) | 0.86 g/m$^2$ |
| Silver (from silver salt SS-1) | 0.64 g/m$^2$ |
| 5-phenyl-1-mercaptotetrazole | 0.32 g/m$^2$ |
| Coupler M-2 | 0.54 g/m$^2$ |
| Lime processed gelatin | 4.31 g/m$^2$ |

Emulsion E-2 is a silver halide tabular emulsion with a composition of 98.7% silver bromide and 1.3% silver iodide, prepared by conventional means. The resulting emulsion had an equivalent circular diameter of 0.6 microns and a thickness of 0.09 microns. This emulsion was spectrally sensitized to yellow light by addition of dye Y-2 and then chemically sensitized for optimum performance. The structure of coupler M-2 is given below. It was incorporated into the photothermographic coatings as an oil-in-water dispersion using tricresyl phosphate as a coupler solvent in the manner well known in the art.

Y-2

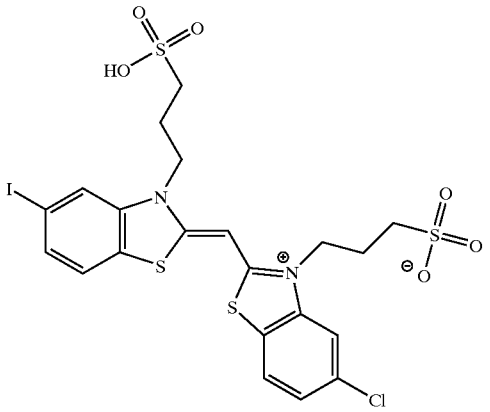

M-2

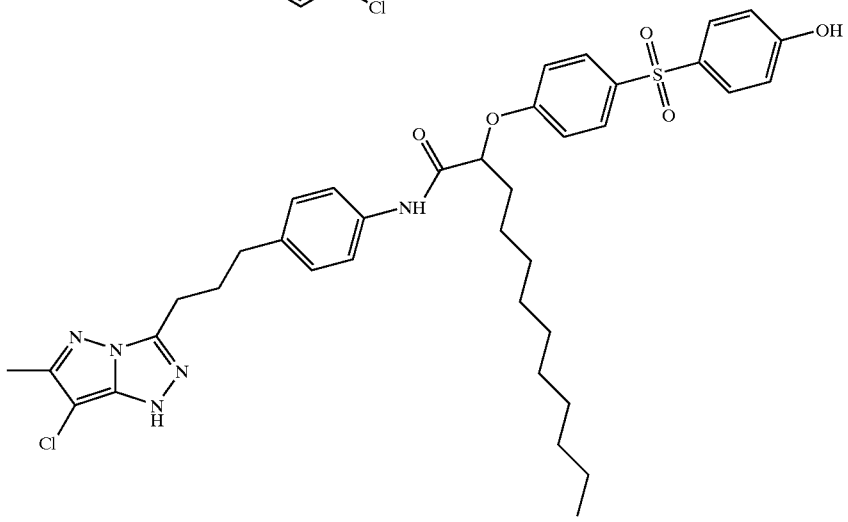

In addition to the above components, each coating also contained developer D-28 or D94BR, or a mixture of the two developers as given in Table 8-3.

TABLE 8-2

D-12

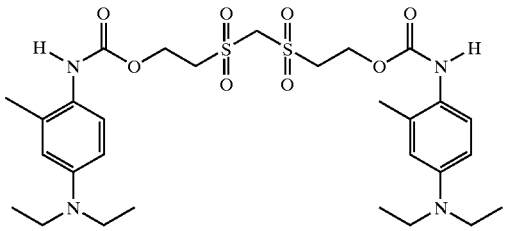

D-55

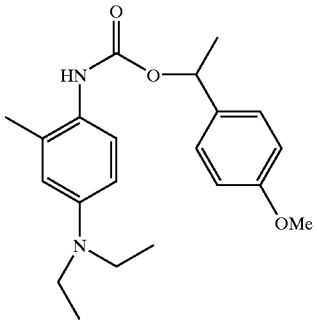

TABLE 8-3

| Coating | Amount of Developer D-12 | Amount of Developer D-55 |
|---|---|---|
| 9-1 | 0.75 g/m$^2$ | 0 g/m$^2$ |
| 9-2 | 0 g/m$^2$ | 0.83 g/m$^2$ |
| 9-3 | 0.60 g/m$^2$ | 0.17 g/m$^2$ |
| 9-4 | 0.45 g/m$^2$ | 0.33 g/m$^2$ |
| 9-5 | 0.30 g/m$^2$ | 0.50 g/m$^2$ |

The resulting coatings were exposed through a step wedge to a 3.04 log lux light source at 3000K filtered by Daylight 5A and Wratten 2B filters. The exposure time was 1 second. Following exposure, the coatings were thermally processed by contact with a heated platen for 20 seconds. A number of strips were processed at a variety of platen temperatures in order to yield an optimum strip process condition. The peak discrimination at a process temperature of 150 degrees C. is given in Table 9-2. Also presented in Table 9-2 is the temperature sensitivity exhibited by each photothermographic coating. The temperature sensitivity is defined as the slope of the peak discrimination versus process temperature. A slope near zero is desired, as it indicates little change in peak discrimination as the process temperature is varied.

TABLE 8-3

| Coating | Developer | $T_O$ | $D_P$ (150° C.) | Temperature Sensitivity |
|---|---|---|---|---|
| 9-1 | D-12 (Comparison) | 135 | 2.86 | 0.21 |
| 9-2 | D-55 (Comparison) | 150 | 1.12 | 0.17 |
| 9-3 | Mixture 1 (Inv.) | 138 | 3.73 | 0.16 |
| 9-4 | Mixture 2 (Inv.) | 140 | 4.12 | 0.13 |
| 9-5 | Mixture 3 (Inv.) | 142 | 3.77 | 0.01 |

It is clear from these examples that photothermographic elements that contain a mixture of two developers exhibit improved relative discrimination compared to either developer when used alone. In addition, the inventive combinations effectively lower the onset temperature for the blocked developer with the higher $T_o$. Furthermore, the photothermographic elements that use a mixture of developers exhibit lower sensitivity to temperature, rendering them more robust to temperature variations in the processing equipment.

EXAMPLE 9

This example demonstrates the advantageous use of a combination of blocked developer in a multilayer film element intended for multiple color capture and reproduction. The following components were used in the creation of this example.

Silver Salt SS-1 (as Described in Example 7)

Silver Salt Dispersion SS-2

A stirred reaction vessel was charged with 431 g of lime processed gelatin and 6569 g of distilled water. A solution containing 320 g of 1-phenyl-5-mercaptotetrazole, 2044 g of distilled water, and 790 g of 2.5 molar sodium hydroxide was prepared (Solution B). The mixture in the reaction vessel was adjusted to a pAg of 7.25 and a pH of 8.00 by additions of Solution B, nitric acid, and sodium hydroxide as needed. A 4 1 solution of 0.54 molar silver nitrate was added to the kettle at 250 cc/minute, and the pAg was maintained at 7.25 by a simultaneous addition of solution B. This process was continued until the silver nitrate solution was exhausted, at which point the mixture was concentrated by ultrafiltration. The resulting silver salt dispersion contained fine particles of the silver salt of 1-phenyl-5-mercaptotetrazole.

TABLE 9-1

| Emulsion | Spectral sensitivity | Iodide content (%) | Diameter (μm) | Thickness (μm) | Dyes |
|---|---|---|---|---|---|
| EY-1 | yellow | 4 | 1.97 | 0.13 | SY-1 |
| EY-2 | yellow | 2 | 1.23 | 0.125 | SY-1 |
| EY-3 | yellow | 2 | 0.42 | 0.061 | SY-1 |
| EY-4 | yellow | 1.95 | 0.653 | 0.092 | SY-1 |
| EY-5 | yellow | 3.4 | 0.16 (cube) | | SY-1 |
| EY-6 | yellow | 3.4 | 0.10 (cube) | | SY-1 |
| EY-7 | yellow | 3.4 | 0.05 (cube) | | SY-1 |
| EM-1 | magenta | 4 | 1.97 | 0.13 | SM-1 + SM-2 |
| EM-2 | magenta | 4 | 1.25 | 0.106 | SM-1 + SM-2 |
| EM-3 | magenta | 2 | 0.42 | 0.061 | SM-1 + SM-2 |
| EM-4 | magenta | 1.95 | 0.653 | 0.092 | SM-1 + SM-2 |
| EM-5 | magenta | 3.4 | 0.16 (cube) | | SM-1 + SM-2 |
| EM-6 | magenta | 3.4 | 0.10 (cube) | | SM-1 + SM-2 |
| EM-7 | magenta | 3.4 | 0.05 (cube) | | SM-1 + SM-2 |
| EC-1 | cyan | 4 | 1.97 | 0.13 | SC-1 + SC-2 |
| EC-2 | cyan | 4 | 1.25 | 0.106 | SC-1 + SC-2 |
| EC-3 | cyan | 2 | 0.42 | 0.061 | SC-1 + SC-2 |
| EC-4 | cyan | 1.95 | 0.653 | 0.092 | SC-1 + SC-2 |
| EC-5 | cyan | 3.4 | 0.16 (cube) | | SC-1 + SC-2 |
| EC-6 | cyan | 3.4 | 0.10 (cube) | | SC-1 + SC-2 |
| EC-7 | cyan | 3.4 | 0.05 (cube) | | SC-1 + SC-2 |

Coupler Dispersion CDM-1

A coupler dispersion was prepared by conventional means containing coupler M-1 without any additional permanent solvents.

Coupler Dispersion CDC-1

An oil based coupler dispersion was prepared by conventional means containing coupler C- I and dibutyl phthalate at a weight ratio of 1:2.

Coupler Dispersion CDY-1

An oil based coupler dispersion was prepared by conventional means containing coupler Y-1 and dibutyl phthalate at a weight ratio of 1:0.5.

Y-1

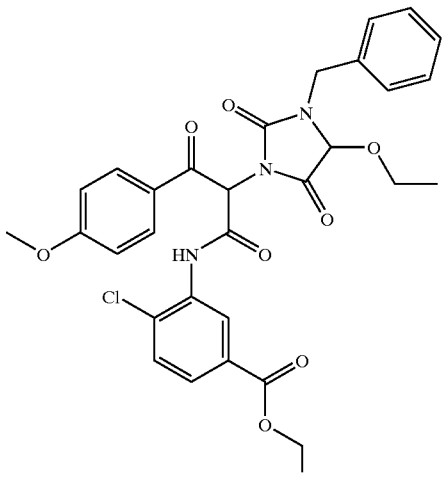

-continued
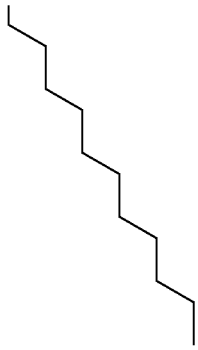
M-1
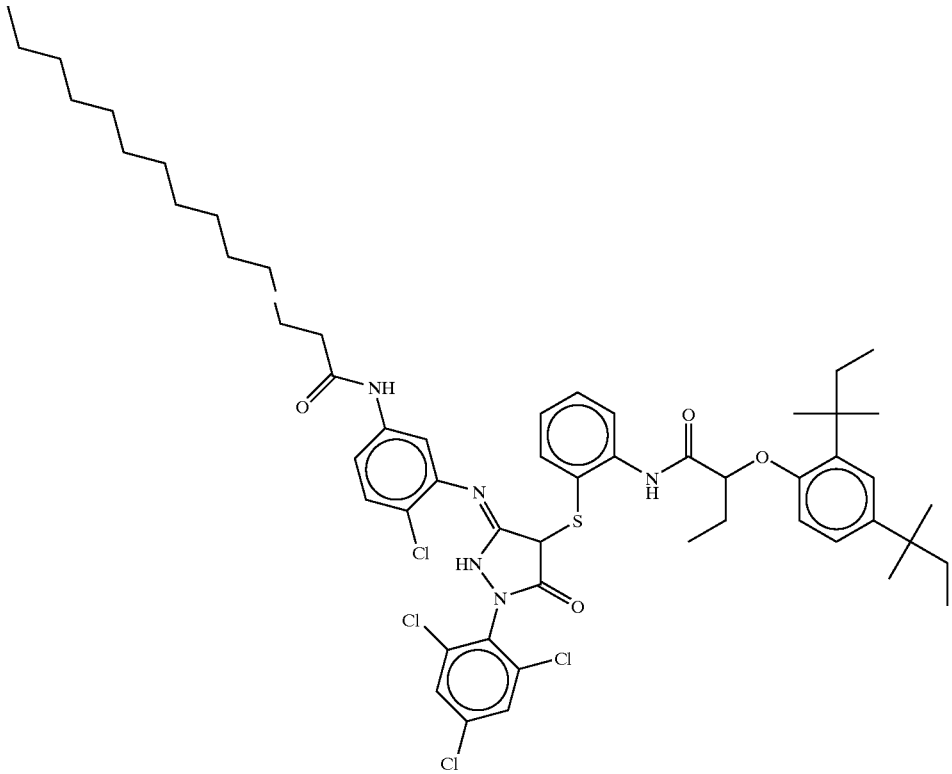
C-1
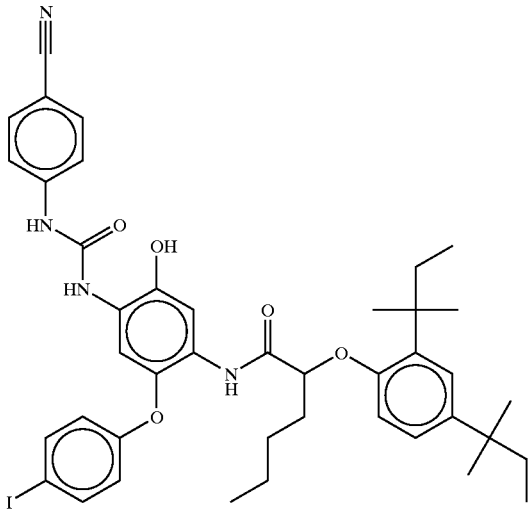
SY-1
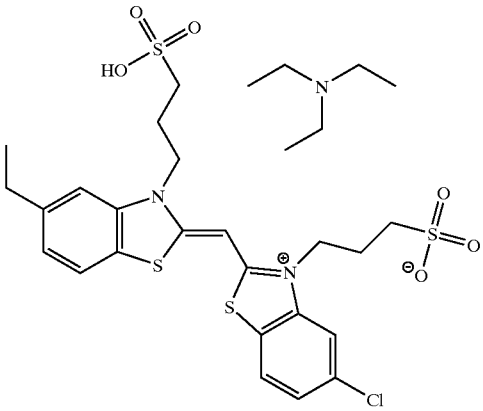

-continued
SY-2
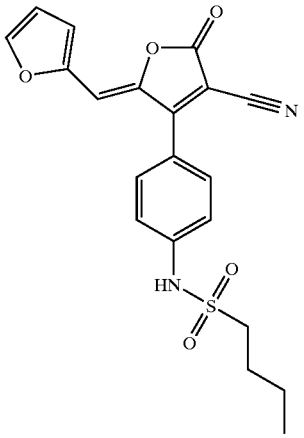
SM-1
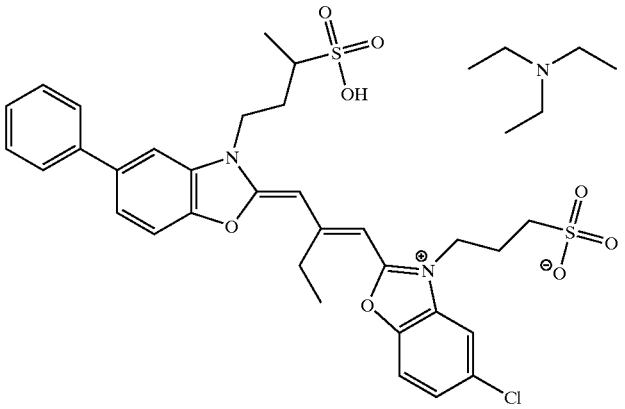
SM-2
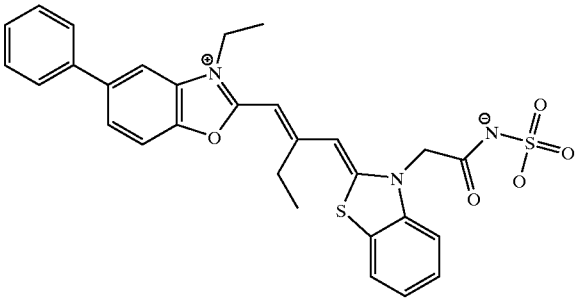
SC-1
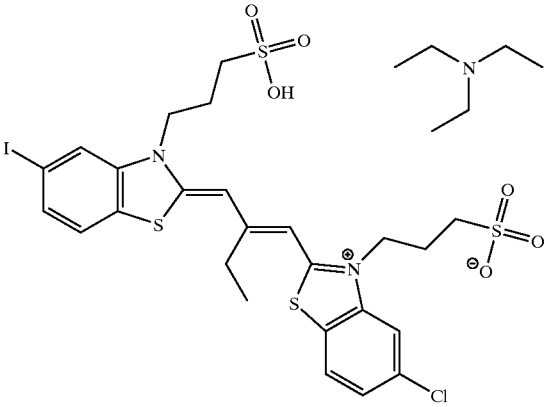
SC-2
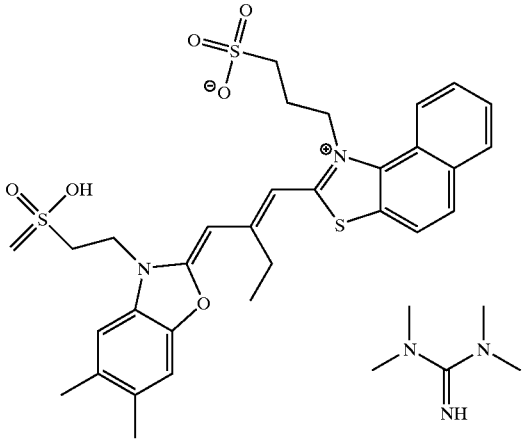
AD-1
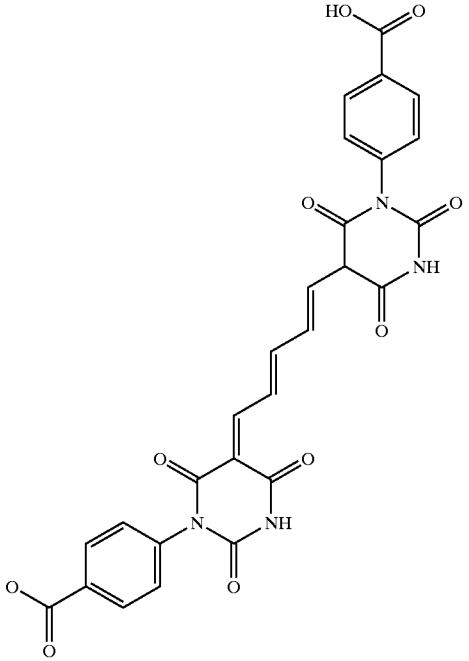

-continued

Hardener-1

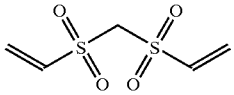

A basic multilayer imaging element as described in table 2-2 was created. Variations in coating examples consisted of changing the respective amounts of developing agents D-1 and D-2 while maintain the overall molar laydowns of developer as listed in Table 10-2 below. The composition of the test coatings is shown in Table 10-3.

TABLE 9-2

| | |
|---|---|
| Overcoat | 1.1 g/m$^2$ Gelatin<br>0.32 g/m$^2$ Hardener-1 |
| Fast Yellow | 0.48 g/m$^2$ AgBrI from emulsion EY-1<br>0.15 g/m$^2$ silver benzotriazole from SS-1<br>0.15 g/m$^2$ silver-1-phenyl-5-mercaptotetrazole from SS-2<br>0.21 g/m2 coupler Y-1 from dispersion CDY-1<br>1.61 mmol/m$^2$ Total Developer<br>0.52 g/m$^2$ Salicylanilide<br>1.56 g/m$^2$ Gelatin |
| Slow Yellow | 0.22 g/m$^2$ AgBrI from emulsion EY-2<br>0.11 g/m$^2$ AgBrI from emulsion EY-3<br>0.092 g/m$^2$ AgBrI from emulsion EY-4<br>0.065 g/m$^2$ AgBrI from emulsion EY-5<br>0.065 g/m$^2$ AgBrI from emulsion EY-6<br>0.43 g/m$^2$ AgBrI from emulsion EY-7<br>0.24 g/m$^2$ silver benzotriazole from SS-1<br>0.24 g/m$^2$ silver-1-phenyl-5-mercaptotetrazole from SS-2<br>0.39 g/m$^2$ coupler Y-1 from dispersion CDY-1<br>1.80 mmol/m$^2$ Total Developer<br>0.58 g/m$^2$ Salicylanilide<br>2.75 g/m$^2$ Gelatin |
| Yellow Filter | 0.13 g/m2 SY-2<br>1.08 g/m2 Gelatin |
| Fast Magenta | 0.48 g/m$^2$ AgBrI from emulsion EM-1<br>0.15 g/m$^2$ silver benzotriazole from SS-1<br>0.15 g/m$^2$ silver-1-phenyl-5-mercaptotetrazole from SS-2<br>0.21 g/m$^2$ coupler M-1 from dispersion CDM-1<br>0.90 mmol/m$^2$ Total Developer<br>0.29 g/m$^2$ Salicylanilide<br>1.56 g/m$^2$ Gelatin |
| Slow Magenta | 0.22 g/m$^2$ AgBrI from emulsion EM-2<br>0.11 g/m$^2$ AgBrI from emulsion EM-3<br>0.11 g/m$^2$ AgBrI from emulsion EM-4<br>0.11 g/m$^2$ AgBrI from emulsion EM-5<br>0.065 g/m$^2$ AgBrI from emulsion EM-6<br>0.065 g/m$^2$ AgBrI from emulsion EM-7<br>0.24 g/m$^2$ silver benzotriazole from SS-1<br>0.24 g/m$^2$ silver-1-phenyl-5-mercaptotetrazole from SS-2<br>0.39 g/m2 coupler M-1 from dispersion CDM-1<br>0.96 mmol/m$^2$ Total Developer<br>0.31 g/m$^2$ Salicylanilide<br>2.75 g/m$^2$ Gelatin |
| Interlayer | 1.07 g/m2 Gelatin |
| Fast Cyan | 0.48 g/m$^2$ AgBrI from emulsion EC-1<br>0.15 g/m$^2$ silver benzotriazole from SS-1<br>0.15 g/m$^2$ silver-1-phenyl-5-mercaptotetrazole from SS-2<br>0.21 g/m2 coupler C-1 from dispersion CDC-1<br>1.61 mmol/m$^2$ Total Developer<br>0.52 g/m$^2$ Salicylanilide<br>1.56 g/m$^2$ Gelatin |
| Slow Cyan | 0.22 g/m$^2$ AgBrI from emulsion EC-2<br>0.11 g/m$^2$ AgBrI from emulsion EC-3<br>0.11 g/m$^2$ AgBrI from emulsion EC-4<br>0.11 g/m$^2$ AgBrI from emulsion EC-5<br>0.065 g/m$^2$ AgBrI from emulsion EC-6<br>0.065 g/m$^2$ AgBrI from emulsion EC-7<br>0.24 g/m$^2$ silver benzotriazole from SS-1<br>0.24 g/m$^2$ silver-1-phenyl-5-mercaptotetrazole from SS-2<br>0.39 g/m2 coupler C-1 from dispersion CDC-1<br>1.80 mmol/m$^2$ Total Developer |

TABLE 9-2-continued

| | |
|---|---|
| Overcoat | 1.1 g/m$^2$ Gelatin<br>0.32 g/m$^2$ Hardener-1 |
| Antihalation Layer | 0.58 g/m$^2$ Salicylanilide<br>2.75 g/m$^2$ Gelatin<br>0.108 g/m2 AD-1<br>1.6 g/m2 Gelatin |
| Support | Polyethylene terephthalate support (4 mil thickness) |

TABLE 9-3

| | Developer Fractions | |
|---|---|---|
| Coating | % Dev-1 | % Dev-2 |
| 2-1 | 100 | 0 |
| 2-2 | 50 | 50 |
| 2-3 | 0 | 100 |

The resulting coatings were exposed through a step wedge to a 2.1 log lux light source at 5500K and Wratten 2B filter. The exposure time was 0.1 seconds. The step wedge contained 21 steps each separated by 0.2 log(E), to yield on overall exposure range of 4.0 log(E).

After exposure, the coating was thermally processed by contact with a heated platen for 20 seconds at 154° C. Cyan, magenta, and yellow densities corresponding to each step were read using status M color profiles. The average gamma of the coatings were calculated for each record by regressing a linear fit to the densities formed from steps that exhibited densities above Dmin. Table 10-4 shows the measured gammas and Dmins of three coatings two of which have pure developers and the other having a combination of 50% of each of Dev-1 and Dev-2. Considering that a minimum gamma of approximately 0.3 is required for faithful image reproduction from a scanning operation, it can be seen that the inventive combination (example 2-2) containing a mixture of developers shows acceptable gamma while maintaining a low Dmin position. The comparative coating with Dev-l alone (example C2-1) shows acceptable gamma but excessive Dmin while the comparative coating with Dev-2 alone (example C2-3) shows acceptable Dmin but insufficient gamma.

TABLE 9-4

| | Gamma | | | Dmin | | |
|---|---|---|---|---|---|---|
| Coating | Cyan | Magenta | Yellow | Cyan | Magenta | Yellow |
| 2-1 (Comp.) | 0.51 | 0.84 | 0.65 | 0.371 | 0.504 | 0.861 |
| 2-2 (Inv.) | 0.38 | 0.67 | 0.52 | 0.160 | 0.322 | 0.675 |
| 2-3 (Comp.) | 0.15 | 0.23 | 0.16 | 0.141 | 0.308 | 0.746 |

The invention has been described in detail with particular reference to preferred embodiments, but it will be understood that variations and modifications can be effected within the spirit and scope of the invention. In particular, the inventive developers can be used in one or more of the layers in full color, multi-layer film formats.

What is claimed is:

1. A photothermographic color element comprising at least three light-sensitive units that have their individual sensitivities in different wavelength regions comprising a silver halide imaging layer having associated therewith a first imaging layer or color unit, referred to as Layer 1 or Color Unit 1, having a mixture of at least two blocked developing agents comprising Blocked Developer A and Blocked Developer B and a second imaging layer or color unit, referred to as Layer 2 or Color Unit 2, having at least one blocked developer C, wherein blocked developers A, B, and C are independently represented by the following Structure:

$$\text{DEV—(LINK 1)}_l\text{—(TIME)}_m\text{—(LINK 2)}_n\text{—M}$$

wherein:

DEV is a silver halide color developing agent;

LINK 1 and LINK 2 are linking groups;

TIME is a timing group;

l is 0 or 1, m is 0, 1, or 2;

n is 0 or 1;

l+n is 1 or 2;

M is a blocking group or W is:

$$\text{—M'—(LINK 2)}_n\text{—(TIME)}_m\text{—(LINK 1)}_l\text{—DEV}$$

wherein M' is blocking group for a second developing agent DEV; and wherein LINK 1 and LINK 2 have the following structure:

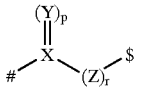

wherein

X represents carbon or sulfur;

Y represents oxygen, sulfur or N—$R_1$, where $R_1$ is substituted or unsubstituted alkyl or substituted or unsubstituted aryl;

p is 1 or 2;

Z represents carbon, oxygen or sulfur, r is 0 or 1;

with the proviso that when X is carbon, both p and r are 1, when X is sulfur, Y is oxygen, p is 2 and r is 0;

# denotes the bond to PUG (for LINK 1) or TIME (for LINK 2):

$ denotes the bond to TIME (for LINK 1) or $T_{(t)}$ substituted carbon (for LINK 2); and wherein the onset temperature of Developer B is less than the onset temperature of Developer A, the onset temperature of Developer B is in the range of 110 to 160° C. and the onset temper of Developer A is 130 to 170° C. and the difference in the onset temperatures of the two developing agents are 5 to 50° C., and wherein the Gamma Ratio at the process temperature of the Gamma in Layer 1 to the Gamma in Layer 2 is between 0.8 and 1.2 and wherein this Gamma ratio is at least 10% closer to 1.0 than if only one of Blocked Developers A, B, and C are independently used in each of Layer 1 and Layer 2; and/or wherein the Dmin Ratio at the process temperature of the Dmin in Layer 1 to the Dmin in Layer 2 is between 0.8 and 1.2, and wherein this Dmin ratio is at least 10% closer to 1.0 than if only one of Blocked Developers A, B, and C are independently used in each of Layer 1 and Layer 2.1 and/or wherein the Latitude Ratio at the process temperature of the Latitude in Layer 1 to the Latitude in Layer 2 is between 0.8 and 1.2 and wherein this Latitude Ratio is at least 10% closer to 1.0 than if only one of Blocked Developers A, B, and C are independently used in each of Layer 1 and Layer 2.

2. A photothermographic color element according to claim 1 wherein Layer 1 and 2 are in different color units.

3. A photothermographic color element according to claim 1 wherein Blocked Developer A is present in the mixture in the amount of 1 to 99 mole percent and Blocked Developer B is present in the mixture in the amount of 99 to 1 mole percent.

4. A photothermographic color element according to claim 1 wherein a third developing agent or a third and fourth developing agent is present in Layer 2.

5. A photothermographic color element according to claim 1 wherein a mixture of at least two blocked developers, Blocked Developer C and Blocked Developer D is present in Layer 2.

6. A photothermographic color element according to claim 1, wherein the developing agent is an aminophenol, phenylenediamine, hydroquinone, pyrazolidinone, or hydrazine.

7. A photothermographic color element according to claim 1, wherein the developer is a phenylenediamine.

8. The photographic element of claim 1 wherein the difference in the onset temperatures of the two developing agents in the mixture are 5 to 50° C.

9. A photothermographic color element according to claim 1 wherein the Dp of the mixture is higher than the Dp of Blocked Developer B.

10. A photothermographic color element according to claim 1, where LINK 1 and LINK 2 are the following:

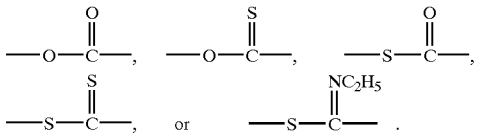

11. A photothermographic color element according to claim 1, wherein LINK 1 is

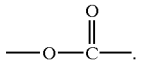

12. A photothermographic color element according to claim 1, wherein TIME is a timing group selected from (1) groups utilizing an aromatic nucleophilic substitution reaction; (2) groups utilizing the cleavage reaction of a hemiacetal; (3) groups utilizing an electron transfer reaction along a conjugated system; or (4) groups using an intramolecular nucleophilic substitution reaction.

13. A photothermographic color element of claim 1 wherein M in Blocked Developer B is:

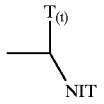

wherein

T represents t independently selected substituted or unsubstituted alkyl or aryl groups, t is 0, 1, or 2 and if t is 2, the T groups can form a ring; and NIT is a disubstituted nitrogen group which optionally can form a ring.

14. A photothermographic color element according to claim 13, wherein NIT is selected from the group consisting of: benzimidazolyl, benzothiazolyl, benzoxazolyl, benzothiophenyl, benzofuryl, furyl, imidazolyl, indazolyl, indolyl, isoquinolyl, isothiazolyl, isoxazolyl, oxazolyl, picolinyl, purinyl, pyranyl, pyrazinyl, pyrazolyl, pyridyl, pyrimidinyl, pyrrolyl, quinaldinyl, quinazolinyl, quinolyl, quinoxalinyl, tetrazolyl, thiadiazolyl, thiatriazolyl, thiazolyl, thiophenyl, triazolyl, N,N-diarylamino, carbazolyl, and substituted derivatives thereof.

15. A photothermographic color element according to claim 13, wherein NIT is selected from the group consisting of: 1-imidazolyl, 1-benzimidazolyl, 1-pyrrolyl, 1-indolyl, 1-carbazolyl, 1-pyrazolyl, 1-indazolyl, N,N-diphenylamino, and 1-tetrahydrocarbazolyl, and substituted derivatives thereof.

16. A photothermographic color element according to claim 1, wherein the Blocked Developer B is of the following structure:

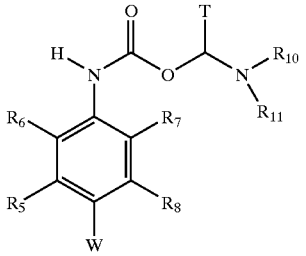

wherein:

NIT is a disubstituted nitrogen group which optionally can form a ring with a the T group;

wherein:

W is OH or $NR_2R_3$, and $R_2$ and $R_3$ are independently hydrogen or a substituted or unsubstituted alkyl group or $R_2$ and $R_3$ are connected to form a ring;

$R_5$, $R_6$, $R_7$, and $R_8$ are independently hydrogen, halogen, hydroxy, amino, alkoxy, carbonamido, sulfonamido, alkylsulfonamido or alkyl, or $R_5$ can connect with $R_3$ or $R_6$ and/or $R_8$ can connect to $R_4$ or $R_7$ to form a ring;

$R_9$ are independently hydrogen, alkyl, aryl, heteroaromatic or alkoxy groups,which can be connected with $R_{10}$ or $R_{11}$ to form a ring;

$R_{10}$ and $R_{11}$ are independently alkyl, aryl, substituted aryl or heteroaromatic subtituents which can be connected to form ring.

17. A photothermographic color element according to claim 1, wherein the Blocked Developer A or both Blocked Developer A and B is of the following structure:

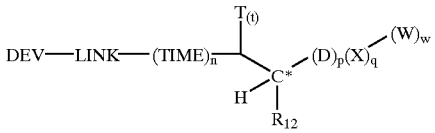

wherein:

DEV is a developing agent;

LINK is a linking group;

TIME is a timing group;

n is 0, 1, or 2;

t is 0, 1, or 2, and when t is not 2, the necessary number of hydrogens (2-t) are present in the structure;

C* is tetrahedral ($sp^3$ hybridized) carbon;

p is 0 or 1;

q is 0 or 1;

w is 0 or 1;

p+q=1 and when p is 1, q and w are both 0; when q is 1, then w is 1;

$R_{12}$ is hydrogen, or a substituted or unsubstituted alkyl, cycloalkyl, aryl or heterocyclic group or $R_{12}$ can combine with W to form a ring;

T is independently selected from a substituted or unsubstituted (referring to the following T groups) alkyl group, cycloalkyl group, aryl, or heterocyclic group, an inorganic monovalent electron withdrawing group, or an inorganic divalent electron withdrawing group capped with at least one C1 to C10 organic group (either an $R_{13}$ or an $R_{13}$ and $R_{14}$ group), preferably capped with a substituted or unsubstituted alkyl or aryl group; or T is joined with W or $R_{12}$ to form a ring; or two T groups can combine to form a ring;

D is a first activating group selected from substituted or unsubstituted (referring to the following D groups) heteroaromatic group or aryl group or monovalent electron withdrawing group, wherein the heteroaromatic can optionally form a ring with T or $R_{12}$;

X is a second activating group and is a divalent electron withdrawing group;

W is W' or a group represented by the following structure:

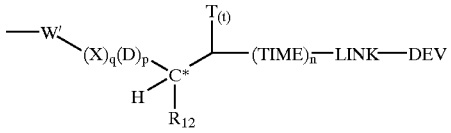

W' is independently selected from a substituted or unsubstituted (referring to the following W' groups) alkyl (preferably containing 1 to 6 carbon atoms), cycloalkyl (including bicycloalkyls, but preferably containing 4 to 6 carbon atoms), aryl (such as phenyl or naphthyl) or heterocyclic group; and wherein W' in combination with T or $R_{12}$ can form a ring;

$R_{13}$, $R_{14}$, $R_{15}$, and $R_{16}$ can independently be selected from substituted or unsubstituted alkyl, aryl, or heterocyclic group; and any two members of the following set: $R_{12}$, T, and either D or W, that are not directly linked may be joined to form a ring, provided that creation of the ring will not interfere with the functioning of the blocking group.

18. A photothermographic color element according to claim 17, wherein the blocked developer is represented by the following structure:

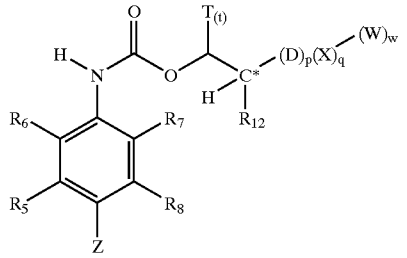

wherein:

Z is OH or $NR_2R_3$, where $R_2$ and $R_3$ are independently hydrogen or a substituted or unsubstituted alkyl group or $R_2$ and $R_3$ are connected to form a ring;

$R_5$, $R_6$, $R_7$, and $R_8$ are independently hydrogen, halogen, hydroxy, amino, alkoxy, carbonamido, sulfonamido, alkylsulfonamido or alkyl, or $R_5$ can connect with $R_3$ or $R_6$ and/or $R_8$ can connect to $R_2$ or $R_7$ to form a ring;

W is either W' or a group represented by the following structure:

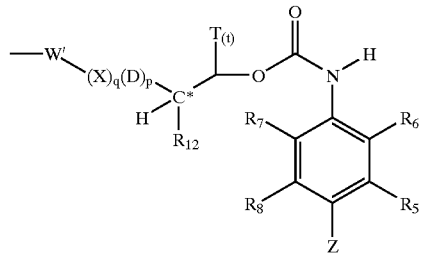

wherein T, t, C*, $R_{12}$, D, p, X, q, W' and w are as defined above.

19. A photothermographic color element according to claim 1, wherein the Blocked Developer B is of the following structure:

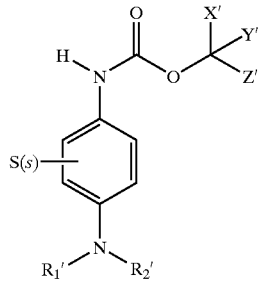

where:

$R_1'$ and $R_2'$ are independently hydrogen or an alkyl group, which may be further substituted, or $R_1'$ and $R_2'$ may join to form a heterocyclic ring;

S represents s independently selected substituents selected from the group consisting of halogen, hydroxy, amino, alkoxy, carbonamido, sulfonamido, alkylsulfonamido or alkyl, any of which may be further substituted or S substituents that are ortho to the $NR_1'R_2'$ substituent can form a heterocyclic ring with $P_1$ or $P_2$; and s is 0 to 4;

X', Y', and Z' represent substituents selected independently from the groups hydrogen, alkyl group of 1 to 6 carbon atoms, cyclopropyl, aryl, arylalkyl, and heterocyclic groups, wherein the cyclopropyl group may be further substituted with an alkyl group of 1 to 6 carbon atoms and the aryl and heterocyclic groups may be in turn substituted with a substituent selected from the group consisting of halogen, alkyl of 1 to 6 carbon atoms, aryl, arylalkyl, alkoxy, aryloxy, arylalkyloxy, alkylthio, arylthio, arylalkylthio, N,N-dialkylamino, N,N-diarylamino, N,N-diarylalkylamino, N-alkyl-N-arylamino, N-alkyl-N-arylalkylamino, and N-aryl-N-arylalkylamino.

20. A photothermographic color element according to claim 1, wherein each unit comprises at least one light-sensitive silver halide emulsion, binder, and dye-providing coupler.

21. A photothermographic color element according to claim 1, wherein the imaging element contains at least unit comprising a non-light sensitive silver salt oxidizing agent and a reducing agent.

22. A method of image formation comprising the step of developing a latent image in an imagewise exposed photothermographic color element according to claim 1.

23. A method according to claim 22, wherein development comprises treating said imagewise exposed element at a temperature between about 90° C. and about 180° C. for a time ranging from about 0.5 to about 60 seconds.

24. A method according to claim 22, wherein development comprises treating said imagewise exposed element to a volume of processing solution is between about 0.1 and about 10 times the volume of solution required to fully swell the photographic element.

25. A method according to claim 22, wherein development is accompanied by the application of a laminate sheet containing processing chemicals.

26. A method according to claim 22, wherein the developing is conducted at a processing temperature between about 20° C. and about 100° C.

27. A method according to claim 22, wherein the processing solution comprises aqueous base, aqueous acid, or pure water.

28. A method of image formation comprising the step of scanning and imagewise exposed and developed imaging element according to claim 23 to form a first electronic image representation of said imagewise exposure.

29. A method of image formation comprising the step of digitizing a first electronic image representation formed from and imagewise exposed, developed, and scanned imaging element according to claim 22 to form a digital image.

30. A method of image formation comprising the step of modifying a first electronic image representation formed from and imagewise exposed, developed, and scanned imaging element formulated according to claim 23 to form a second electronic image representation.

31. A method of image formation comprising storing, transmitting, printing, or displaying and electronic image representation of an image derived from an imagewise exposed, developed, scanned imaging element formulated according to claim 22.

32. A method according to claim 31, wherein said electronic image representation is a digital image.

33. A method according to claim 31, wherein printing the image is accomplished with any of the following printing technologies:

Electrophotography;

Inkjet;

Thermal dye sublimation; or

CRT or LED printing to sensitized photographic paper.

34. A photothermographic color element comprising at least three light-sensitive units that have their individual sensitivities in different wavelength regions comprising a silver halide imaging layer having associated therewith a first imaging layer or color unit, referred to as Layer 1 or Color Unit 1, having a mixture of at least two blocked developing agents comprising Blocked Developer A and Blocked Developer B and a second imaging layer or color unit, referred to as Layer 2 or Color Unit 2, having at least one blocked developer C, wherein blocked developers A, B, and C are independently represented by the following Structure:

$$\text{DEV—(LINK 1)}_l\text{—(TIME)}_m\text{—(LINK 2)}_n\text{—M}$$

wherein:

DBV is a silver halide color developing agent;

LINK 1 and LINK 2 are linking groups,

TIME is a timing group;

l is 0 or 1;

m is 0, 1, or 2;

n is 0 or 1;

l+n is 1 or 2;

M is a blocking group or M is:

$$\text{—M'—(LINK 2 )}_n\text{—(TIME)}_m\text{—(LINK 1)}_1\text{—}_l\text{ DEV}$$

wherein M' is blocking group for a second developing agent DEV; and wherein LINK I and LINK 2 have the following structure

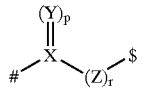

wherein

X represents carbon or sulfur;

Y represents oxygen, sulfur or N—$R_1$, where $R_1$ is substituted or unsubstituted alkyl or substituted or unsubstituted aryl;

p is 1 or 2;

Z represents carbon, oxygen or sulfur;

r is 0 or 1;

with the proviso that when X is carbon, both p and r are 1, when X is sulfur, Y is oxygen, p is 2 and r is 0;

# denotes the bond to PUG (for LINK 1) or TIME (for LINK 2):

$ denotes the bond to TIME (for LINK 1) or $T_{(t)}$ substituted carbon (for LINK 2); and wherein the onset temperature of Developer B is less than the onset temperature of Developer A, the onset temperature of Developer B is in the range of 110 to 160° C. and the onset temperature of Developer A is 130 to 170° C. and the difference in the onset temperatures of the two developing agents are 5 to 50° C., and wherein the Gamma Ratio at the process temperature of the Gamma in Layer 1 to the Gamma in Layer 2 is between 0.8 and 1.2 and wherein this Gamma Ratio is at least 10% closer to 1.0 than if only one of Blocked Developers A, B, and C are independently used in each of Layer 1 and Layer 2; and/or wherein the Dmin Ratio at the process temperature of the Dmin in Layer 1 to the Dmin in Layer 2 is between 0.8 and 1.2, and wherein this Dmin ratio is at least 10% closer to 1.0 than if only one of Blocked Developers A, B, and C are independently used in each of Layer 1 and Layer 2; and/or wherein the Latitude Ratio at the process temperature of the Latitude in Layer 1 to the Latitude in Layer 2 is between 0.8 and 1.2 and wherein this Latitude Ratio is at least 10% closer to 1.0 than if only one of Blocked Developers A, B, and C are independently used in each of Layer 1 and Layer 2, wherein the Blocked Developer A or both Blocked Developer A and B is of the following structure:

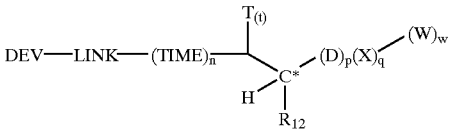

wherein:

DEV is a developing agent;

LINK is a linking group;

TIME is a timing group;

n is 0, 1, or 2;

t is 0, 1, or 2, and when t is not 2, the necessary number of hydrogens (2-t) are present in the structure;

C* is tetrahedral ($sp^3$ hybridized) carbon;

p is 0 or 1;

q is 0 or 1;

w is 0 or 1;

p+q=1 and when p is 1, q and w are both 0; when q is 1, then w is 1;

$R_{12}$ is hydrogen, or a substituted or unsubstituted alkyl, cycloalkyl, aryl or heterocyclic group or $R_{12}$ can combine with W to form a ring;

T is independently selected from a substituted or unsubstituted (referring to the following T groups) alkyl group, cycloalkyl group, aryl, or heterocyclic group, an inorganic monovalent electron withdrawing group, or an inorganic divalent electron withdrawing group capped with at least one C1 to C10 organic group (either an $R_{13}$ or an $R_{13}$ and $R_{14}$ group); or T is joined with W or $R_{12}$ to form a ring; or two T groups can combine to form a ring;

D is a first activating group selected from substituted or unsubstituted (referring to the following D groups) heteroaromatic group or aryl group or monovalent electron withdrawing group, wherein the heteroaromatic can optionally form a ring with T or $R_{12}$;

X is a second activating group and is a divalent electron withdrawing group;

W is W' or a group represented by the following structure:

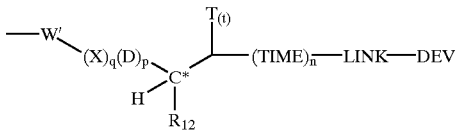

wherein W' is independently selected from a substituted or unsubstituted (referring to the following W' groups) alkyl, cycloalkyl, aryl or heterocyclic group; and wherein W' in combination on with T or $R_{12}$ can form a ring;

$R_{13}$, $R_{14}$, $R_{15}$, ad $R_{16}$ can independently be selected from substituted or unsubstituted alkyl, aryl, or heterocyclic group; and any two members of the following set: $R_{12}$, T, and either D or W, that are not directly linked may be joined to form a ring, provided that creation of the ring will not interfere with the functioning of the blocking group.

35. A photothermographic color element of claim 34 wherein M in Blocked Developer B is:

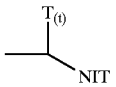

wherein

T represents t independently selected substituted or unsubstituted alkyl or aryl groups, t is 0, 1, or 2 and if t is 2, the T groups can form a ring; and NIT is a disubstituted nitrogen group which optionally can form a ring.

36. A photothermographic color element according to claim 34, wherein the Blocked Developer B is of the following structure:

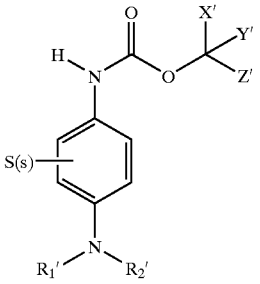

where:

$R_1'$ and $R_2'$ are independently hydrogen or an alkyl group, which may be further substituted, or $R_1'$ and $R_2'$ may join to form a heterocyclic ring;

S represents s independently selected substituents selected from the group consisting of halogen, hydroxy, amino, alkoxy, carbonamido, sulfonamido, alkylsulfonamido or alkyl, any of which may be further substituted or S substituents that are ortho to the $NR_1'R_2'$ substituent call form a heterocyclic ring with $P_1$ or $P_2$; and s is 0 to 4;

X', Y', and Z' represent substituents selected independently from the groups hydrogen, alkyl group of 1 to 6 carbon atoms, cyclopropyl, aryl, arylalkyl, and heterocyclic groups, wherein the cyclopropyl group may be further substituted with an alkyl group of 1 to 6 carbon atoms and the aryl and heterocyclic groups may be in turn substituted with a substituent selected from the group consisting of halogen, alkyl of 1 to 6 carbon atoms, aryl, arylalkyl, alkoxy, aryloxy, arylalkyloxy, alkylthio, arylthio, arylalkylthio, N,N-dialkylamino, N,N-diarylamino, N,N-diarylalkylamino, N-alkyl-N-arylamino, N-alkyl-N-arylalkylamino, and N-aryl-N-arylalkylamino.

* * * * *